US007395955B2

(12) United States Patent
Zins et al.

(10) Patent No.: US 7,395,955 B2
(45) Date of Patent: Jul. 8, 2008

(54) STAPLER

(75) Inventors: Kenneth Zins, Fitchburg, MA (US); Paul Severino, Islip, NY (US); Robert Doran, River Vale, NJ (US); Mitch Maiman, Holbrook, NY (US); Yuri Gofman, Brooklyn, NY (US); Ryan McGann, Shoreham, NY (US)

(73) Assignee: Staples The Office Superstore, LLC, Framingham, MA (US)

( * ) Notice: Subject to any disclaimer, the term of this patent is extended or adjusted under 35 U.S.C. 154(b) by 46 days.

(21) Appl. No.: 11/327,162

(22) Filed: Jan. 6, 2006

(65) Prior Publication Data

US 2007/0158384 A1 Jul. 12, 2007

(51) Int. Cl.
*B25C 5/06* (2006.01)

(52) U.S. Cl. ..... 227/132

(58) Field of Classification Search ..... 227/2, 227/132, 120, 129, 134, 126
See application file for complete search history.

(56) References Cited

U.S. PATENT DOCUMENTS

| | | | |
|---|---|---|---|
| 1,709,756 | A | 4/1929 | Szepe |
| 1,919,373 | A | 2/1933 | Krantz |
| 1,945,377 | A | 1/1934 | Posnack |
| 1,994,567 | A | 3/1935 | Cavanagh |
| 2,309,628 | A | 2/1943 | Crosby |
| 2,326,540 | A | 8/1943 | Krantz |
| 2,401,840 | A | 6/1946 | Olson |
| 2,412,620 | A | 12/1946 | Kipp |
| 2,645,772 | A | 7/1953 | Walker |
| 2,671,215 | A | 3/1954 | Abrams |
| 2,719,294 | A | 10/1955 | Marano |
| 2,769,174 | A | 11/1956 | Libert |
| 2,945,236 | A | 7/1960 | Kopf et al. |
| 3,016,538 | A | 1/1962 | Oussani |
| 3,034,128 | A | 5/1962 | Robbins |
| 3,149,339 | A | 9/1964 | Johnson |
| 3,229,882 | A | 1/1966 | Abrams |
| 3,563,513 | A | 2/1971 | Rubin |
| 3,596,820 | A | 8/1971 | Lou |
| 3,610,505 | A | 10/1971 | Males |
| 3,626,913 | A | 12/1971 | Sarto |
| 3,630,428 | A | 12/1971 | Olney |
| 3,670,942 | A | 6/1972 | Pomeroy |
| 3,672,635 | A | 6/1972 | Munson et al. |
| 3,739,973 | A | 6/1973 | Abrams |

(Continued)

FOREIGN PATENT DOCUMENTS

| | | |
|---|---|---|
| CA | 2059833 | 7/1993 |

(Continued)

*Primary Examiner*—Scott A. Smith
(74) *Attorney, Agent, or Firm*—Wolf, Greenfield & Sacks, P.C.

(57) ABSTRACT

A stapler includes a body and a strike plate movably mounted to the body between a rest position and a loaded position. The strike plate is adapted to drive a staple into a target object. The strike plate may be moved from the rest position to the loaded position by a loading mechanism against the bias of a power spring, whereupon the energy stored in the power spring is applied to the strike plate to drive the staple. A stapler may include a lockout which inhibits movement of the strike plate toward the loaded position unless a work piece is beneath the stapler body.

55 Claims, 14 Drawing Sheets

U.S. PATENT DOCUMENTS

| | | | |
|---|---|---|---|
| 3,743,161 | A | 7/1973 | Spencer |
| 3,753,524 | A | 8/1973 | Heyward |
| 3,786,978 | A | 1/1974 | Manganaro |
| 3,809,307 | A | 5/1974 | Wandel et al. |
| 3,858,780 | A | 1/1975 | Perkins et al. |
| 3,862,712 | A | 1/1975 | LaPointe et al. |
| 3,907,190 | A | 9/1975 | Mitsuhashi |
| 3,913,817 | A | 10/1975 | Barrett et al. |
| 3,923,228 | A | 12/1975 | Leff et al. |
| 3,940,044 | A | 2/1976 | LaPointe |
| 3,948,426 | A | 4/1976 | La Pointe |
| 3,951,325 | A | 4/1976 | Mitsuhashi |
| 3,958,738 | A | 5/1976 | Tremblay |
| 3,971,969 | A | 7/1976 | Wines et al. |
| 4,002,281 | A | 1/1977 | Hsu |
| 4,025,031 | A | 5/1977 | Chi |
| 4,033,500 | A | 7/1977 | Manganaro |
| 4,040,556 | A | 8/1977 | Dahle |
| 4,041,598 | A | 8/1977 | D'Angelo et al. |
| 4,089,099 | A | 5/1978 | Nivet |
| 4,113,164 | A | 9/1978 | Muthenthaller |
| 4,114,793 | A | 9/1978 | Hsu |
| 4,119,258 | A | 10/1978 | Ewig, Jr. |
| 4,126,260 | A | 11/1978 | Mickelsson |
| 4,133,468 | A | 1/1979 | Ewig |
| 4,150,774 | A | 4/1979 | Wright |
| 4,155,498 | A | 5/1979 | Ewig |
| 4,184,620 | A | 1/1980 | Ewig |
| 4,204,622 | A | 5/1980 | Smith et al. |
| 4,225,075 | A | 9/1980 | Chi |
| 4,358,043 | A | 11/1982 | Chi |
| 4,367,833 | A | 1/1983 | Kenney |
| 4,399,938 | A | 8/1983 | Biddle |
| 4,432,484 | A | 2/1984 | Maestri |
| 4,450,998 | A | 5/1984 | Ruskin |
| 4,452,388 | A | 6/1984 | Fealey |
| 4,463,890 | A | 8/1984 | Ruskin |
| 4,470,532 | A | 9/1984 | Froehlich |
| 4,483,066 | A | 11/1984 | Akira |
| 4,496,091 | A | 1/1985 | Yasuda |
| 4,505,416 | A | 3/1985 | Smallegan |
| 4,515,356 | A | 5/1985 | Mullritter et al. |
| 4,519,532 | A | 5/1985 | Foslien |
| 4,540,110 | A | 9/1985 | Bent et al. |
| 4,566,621 | A | 1/1986 | Becht |
| 4,573,624 | A | 3/1986 | Muller et al. |
| 4,583,276 | A | 4/1986 | Olesen |
| 4,591,086 | A | 5/1986 | Campbell et al. |
| 4,597,517 | A | 7/1986 | Wagdy |
| 4,616,774 | A | 10/1986 | Yasuda |
| 4,618,087 | A | 10/1986 | Lai |
| 4,623,084 | A | 11/1986 | Olesen |
| 4,624,401 | A | 11/1986 | Gassner et al. |
| 4,629,106 | A | 12/1986 | Howard et al. |
| 4,629,108 | A | 12/1986 | Judge |
| 4,637,538 | A | 1/1987 | Wagner |
| 4,640,451 | A | 2/1987 | Steiner et al. |
| 4,650,105 | A | 3/1987 | Kihara |
| 4,662,555 | A | 5/1987 | Thornton |
| 4,666,075 | A | 5/1987 | Olesen |
| 4,676,423 | A | 6/1987 | Ghibely |
| 4,705,202 | A | 11/1987 | Olesen et al. |
| 4,706,866 | A | 11/1987 | Ebihara |
| 4,724,990 | A | 2/1988 | Yoshieda et al. |
| 4,724,992 | A | 2/1988 | Ohmori |
| 4,747,530 | A | 5/1988 | Chang |
| 4,753,346 | A | 6/1988 | Tsuji |
| 4,784,307 | A | 11/1988 | Ebihara |
| 4,821,938 | A | 4/1989 | Haytayan |
| 4,838,470 | A | 6/1989 | Chang |
| D302,102 | S | 7/1989 | Amagaya |
| 4,869,415 | A | 9/1989 | Fox |
| 4,944,491 | A | 7/1990 | Kirk |
| 5,009,356 | A | 4/1991 | Chang |
| 5,035,354 | A | 7/1991 | Meyer |
| 5,038,992 | A | 8/1991 | Shiang et al. |
| D322,143 | S | 12/1991 | Spreckelmeier |
| 5,088,692 | A | 2/1992 | Weiler |
| 5,094,380 | A | 3/1992 | Nasiatka |
| D326,323 | S | 5/1992 | Hunt et al. |
| D327,323 | S | 6/1992 | Hunt |
| 5,133,493 | A | 7/1992 | Russel et al. |
| D329,790 | S | 9/1992 | Chi |
| D329,791 | S | 9/1992 | Chi |
| D330,317 | S | 10/1992 | Jacober et al. |
| D330,666 | S | 11/1992 | Chan |
| D331,000 | S | 11/1992 | Doorley |
| D331,001 | S | 11/1992 | Hu Huang |
| D331,002 | S | 11/1992 | Oliver |
| D331,178 | S | 11/1992 | Bain et al. |
| 5,165,587 | A | 11/1992 | Marks |
| D332,732 | S | 1/1993 | Matsuno |
| 5,183,196 | A | 2/1993 | Miyashita |
| 5,184,765 | A | 2/1993 | Orozco |
| D333,957 | S | 3/1993 | Chan |
| D334,327 | S | 3/1993 | Hiromori |
| D336,226 | S | 6/1993 | Binon |
| D336,838 | S | 6/1993 | Ishii |
| D337,640 | S | 7/1993 | Olson |
| D337,928 | S | 8/1993 | Huang |
| D338,729 | S | 8/1993 | Sprecklemeier et al. |
| D339,043 | S | 9/1993 | Chi |
| D340,630 | S | 10/1993 | Hara |
| D340,847 | S | 11/1993 | Bain et al. |
| 5,263,628 | A | 11/1993 | Huang |
| D343,000 | S | 1/1994 | Olson |
| D345,795 | S | 4/1994 | Green et al. |
| D347,474 | S | 5/1994 | Olson |
| 5,307,976 | A | 5/1994 | Olson et al. |
| D348,930 | S | 7/1994 | Olson |
| 5,328,075 | A | 7/1994 | Marks |
| 5,335,838 | A | 8/1994 | Harris et al. |
| 5,335,839 | A | 8/1994 | Fealey |
| 5,354,042 | A | 10/1994 | Coombs |
| 5,356,063 | A | 10/1994 | Perez |
| D352,433 | S | 11/1994 | Smith |
| D352,434 | S | 11/1994 | Chi |
| D352,435 | S | 11/1994 | Chi |
| D353,983 | S | 1/1995 | Rosenblad |
| D354,209 | S | 1/1995 | Haluska |
| D355,822 | S | 2/1995 | Smith |
| D357,535 | S | 4/1995 | Grant et al. |
| 5,407,118 | A | 4/1995 | Marks |
| D357,981 | S | 5/1995 | Green et al. |
| D358,346 | S | 5/1995 | Dallas |
| 5,421,502 | A | 6/1995 | Huang |
| 5,425,488 | A | 6/1995 | Thompson |
| 5,427,299 | A | 6/1995 | Marks |
| D360,566 | S | 7/1995 | Marks et al. |
| D361,025 | S | 8/1995 | Ho |
| D361,486 | S | 8/1995 | Yang |
| 5,458,279 | A | 10/1995 | Plyley |
| 5,460,314 | A | 10/1995 | Udagawa |
| D367,414 | S | 2/1996 | Chi |
| 5,492,261 | A | 2/1996 | Chi |
| 5,497,932 | A | 3/1996 | Brewer et al. |
| 5,505,362 | A | 4/1996 | Marks |
| 5,509,595 | A | 4/1996 | Ho |
| 5,511,716 | A | 4/1996 | Marks |
| D369,729 | S | 5/1996 | Herbst et al. |
| D369,730 | S | 5/1996 | Herbst et al. |
| D370,607 | S | 6/1996 | Herbst et al. |
| D371,495 | S | 7/1996 | Herbst et al. |
| D371,496 | S | 7/1996 | Herbst et al. |

D372,737 S 8/1996 Herbst et al.
D373,057 S 8/1996 Chen
D373,058 S 8/1996 Herbst et al.
D374,385 S 10/1996 Herbst et al.
5,560,529 A 10/1996 Udagawa et al.
5,575,054 A 11/1996 Klinzing et al.
D377,590 S 1/1997 Lai
D377,950 S 2/1997 Shen et al.
D379,228 S 5/1997 Rahimzadeh et al.
D380,635 S 7/1997 Brotz
D383,783 S 9/1997 Jeter et al.
D384,259 S 9/1997 Smith
5,664,722 A 9/1997 Marks
5,690,268 A 11/1997 Evans et al.
D387,646 S 12/1997 Arns
5,699,949 A * 12/1997 Marks ..... 227/132
D389,713 S 1/1998 Cochrane et al.
D392,528 S 3/1998 Rossetto et al.
D392,858 S 3/1998 Jacquet
5,730,438 A 3/1998 Webb et al.
D394,194 S 5/1998 Brunsdon et al.
D394,591 S 5/1998 Jacquet
D394,592 S 5/1998 Brunsdon et al.
5,765,742 A 6/1998 Marks
5,791,545 A 8/1998 Lin
5,794,831 A 8/1998 Velan et al.
5,797,535 A 8/1998 Lovegrove et al.
5,816,470 A 10/1998 Plato et al.
D401,487 S 11/1998 Price
5,836,501 A 11/1998 Lai
D401,825 S 12/1998 Parsey et al.
D403,016 S 12/1998 Bedol et al.
5,873,508 A 2/1999 MacVicar et al.
D406,996 S 3/1999 Matthes
5,881,941 A 3/1999 Lai
5,897,046 A 4/1999 Oehri et al.
D411,423 S 6/1999 Huang
D411,724 S 6/1999 Sawyer
D411,725 S 6/1999 Matthes
5,911,350 A 6/1999 Bolger et al.
5,911,761 A 6/1999 Tilley
5,927,585 A 7/1999 Moorman et al.
D413,239 S 8/1999 Lovegrove et al.
5,931,364 A 8/1999 Dennis
5,941,441 A 8/1999 Ilagan
D413,501 S 9/1999 Parsey et al.
D414,091 S 9/1999 Rellinger
D414,999 S 10/1999 Wilson et al.
D415,668 S 10/1999 Elie
D416,454 S 11/1999 Lovegrove et al.
D416,774 S 11/1999 Huang
5,979,734 A 11/1999 Chang
5,979,736 A 11/1999 Edeholt
5,988,478 A 11/1999 Marks
D417,375 S 12/1999 Fealey et al.
D419,411 S 1/2000 Elie
D420,266 S 2/2000 Berry et al.
D422,862 S 4/2000 Wilson et al.
D423,892 S 5/2000 Sawyer
D424,898 S 5/2000 Wilson et al.
6,062,457 A 5/2000 Huang
D426,122 S 6/2000 Wu
D429,453 S 8/2000 Imboden et al.
D431,167 S 9/2000 Brown
6,116,488 A 9/2000 Lee
D432,881 S 10/2000 Chen
D432,884 S 10/2000 Chen
6,131,788 A 10/2000 Marks
6,142,355 A 11/2000 Wu
6,145,728 A * 11/2000 Marks ..... 227/132
6,152,347 A 11/2000 Wilson et al.
D434,628 S 12/2000 Etter et al.
D436,009 S 1/2001 Chi Kuo
D436,010 S 1/2001 Nakamura
6,179,194 B1 1/2001 Morton
D437,754 S 2/2001 Jacquet
D437,755 S 2/2001 Robillard
6,186,385 B1 2/2001 Huang
6,199,739 B1 3/2001 Mukoyama et al.
6,209,770 B1 4/2001 Perra
6,224,035 B1 5/2001 Parkhe et al.
6,244,489 B1 6/2001 Laurie
D445,323 S 7/2001 Arns
6,267,284 B1 7/2001 Clark
D446,430 S 8/2001 Arns
D447,396 S 9/2001 Arns
6,286,745 B1 9/2001 Ackeret
D454,289 S 3/2002 Huang
6,355,892 B1 3/2002 Marks
D455,784 S 4/2002 FitzGerald
6,371,349 B2 4/2002 Laurie
6,371,351 B1 4/2002 Magnusson
D457,794 S 5/2002 Jacquet
6,427,896 B1 8/2002 Ho et al.
D462,995 S 9/2002 Robillard
D463,494 S 9/2002 Mori
D463,724 S 10/2002 Jacquet
6,457,625 B1 10/2002 Törmälä et al.
6,460,433 B1 10/2002 Ackeret et al.
D465,139 S 11/2002 Robillard
D466,774 S 12/2002 Lee
D467,618 S 12/2002 Gstalder
D467,778 S 12/2002 Nolan
6,493,893 B1 12/2002 Ackeret
D468,772 S 1/2003 Robillard
D468,981 S 1/2003 Nolan
D470,024 S 2/2003 Robillard
D470,025 S 2/2003 Joss et al.
6,513,788 B1 2/2003 Ashe
D471,413 S 3/2003 Fukuda
D471,414 S 3/2003 Chan
6,536,646 B1 3/2003 Pinczewski
D472,436 S 4/2003 Scola et al.
D472,437 S 4/2003 Scola et al.
D475,905 S 6/2003 Kruger
D475,906 S 6/2003 Arns
6,578,751 B2 6/2003 Hartwick
D476,869 S 7/2003 Wong
D477,513 S 7/2003 Bor
D477,514 S 7/2003 Chen
D477,760 S 7/2003 Chang
D477,762 S 7/2003 Bor
6,588,642 B1 7/2003 Wang et al.
D477,975 S 8/2003 Lai
D477,976 S 8/2003 Liu
D478,485 S 8/2003 Huang
D478,486 S 8/2003 Scola et al.
D478,490 S 8/2003 Wu
D478,797 S 8/2003 Kramer et al.
D478,798 S 8/2003 Huang
D478,799 S 8/2003 Chi Kuo
D479,449 S 9/2003 Kramer et al.
D479,678 S 9/2003 Huang
D480,287 S 10/2003 Scola et al.
D482,584 S 11/2003 Racamier
6,662,991 B1 12/2003 Huang
D487,006 S 2/2004 Lee
D487,007 S 2/2004 Lee
6,708,360 B2 3/2004 Ackeret
D489,094 S 4/2004 Bodum
6,726,081 B1 4/2004 Lin
D489,237 S 5/2004 Chue
D490,287 S 5/2004 Bodum
D492,174 S 6/2004 Huang
D492,558 S 7/2004 Singleton et al.
D493,083 S 7/2004 Lammers et al.

| | | | | |
|---|---|---|---|---|
| D493,343 | S | 7/2004 | Chen | |
| 6,776,321 | B2 | 8/2004 | Jairam et al. | |
| 6,779,425 | B2 | 8/2004 | Ackeret et al. | |
| 6,783,043 | B2 | 8/2004 | Jakob et al. | |
| 6,783,044 | B2 | 8/2004 | Perra et al. | |
| 6,789,719 | B2 | 9/2004 | Shor | |
| 6,820,787 | B2 | 11/2004 | Pinczewski et al. | |
| 6,820,788 | B2 | 11/2004 | Akiba | |
| 6,848,607 | B2 | 2/2005 | Boswinkel et al. | |
| D502,369 | S | 3/2005 | Nakamura | |
| D502,850 | S | 3/2005 | Sauter et al. | |
| D502,851 | S | 3/2005 | Sauter et al. | |
| D503,320 | S | 3/2005 | Adams et al. | |
| D503,321 | S | 3/2005 | Harris | |
| D503,877 | S | 4/2005 | Adams et al. | |
| 6,874,189 | B2 | 4/2005 | Ackeret | |
| D505,606 | S | 5/2005 | Sinisi | |
| D506,659 | S | 6/2005 | Bodum | |
| 6,918,525 | B2 | 7/2005 | Marks | |
| 6,941,604 | B2 | 9/2005 | Ackeret | |
| 6,948,409 | B2 | 9/2005 | Ackeret et al. | |
| 6,948,647 | B1 | 9/2005 | Niblett et al. | |
| 7,097,088 | B2 * | 8/2006 | Shor | 227/132 |
| 7,121,444 | B2 * | 10/2006 | Joyce | 227/132 |
| 7,124,922 | B2 * | 10/2006 | Marks | 227/8 |
| 2002/0064040 | A1 | 5/2002 | Padden | |
| 2003/0010803 | A1 | 1/2003 | Schuster | |
| 2003/0155400 | A1 | 8/2003 | Anthony et al. | |
| 2004/0040999 | A1 | 3/2004 | Ackeret | |
| 2004/0216240 | A1 | 11/2004 | Kramer et al. | |
| 2004/0232610 | A1 | 11/2004 | Saito et al. | |
| 2004/0245308 | A1 | 12/2004 | Arnold et al. | |
| 2005/0023319 | A1 | 2/2005 | Huang | |
| 2005/0067456 | A1 | 3/2005 | Lammers et al. | |
| 2005/0098604 | A1 | 5/2005 | Marks | |
| 2005/0127129 | A1 | 6/2005 | Marks | |
| 2005/0139631 | A1 | 6/2005 | Marks | |
| 2005/0184120 | A1 | 8/2005 | Terrell et al. | |
| 2005/0223498 | A1 | 10/2005 | Kirby et al. | |
| 2006/0186170 | A1 | 8/2006 | Marks | |

FOREIGN PATENT DOCUMENTS

| | | | |
|---|---|---|---|
| DE | 255111 | | 6/1948 |
| DE | 807 937 | | 1/1959 |
| DE | 28 56 621 | A1 | 7/1980 |
| EP | 0 254 775 | A1 | 2/1988 |
| EP | 0 281 541 | A1 | 9/1988 |
| EP | 0 543 371 | A1 | 5/1993 |
| EP | 0 555 035 | B1 | 12/1995 |
| FR | 2 477 458 | | 9/1981 |
| GB | 540611 | | 10/1941 |
| GB | 1 114963 | | 5/1968 |
| GB | 1 364 336 | | 8/1974 |
| GB | 1 492 217 | | 11/1977 |
| GB | 1 536 527 | | 12/1978 |
| GB | 2 032 327 | A | 5/1980 |
| GB | 2 229 129 | A | 9/1990 |
| GB | 2 298 384 | A | 9/1996 |
| JP | 62-68285 | | 3/1987 |
| JP | 07-266253 | | 10/1995 |
| JP | 11058259 | | 2/1999 |
| JP | 2003/211369 | A | 7/2003 |
| JP | 2004/188571 | A | 7/2004 |
| WO | WO 96/38267 | A | 12/1996 |
| WO | WO 97/04924 | A2 | 2/1997 |
| WO | WO 98/33627 | | 8/1998 |
| WO | WO 98/45094 | | 10/1998 |
| WO | WO 2005/097427 | A2 | 10/2005 |
| WO | WO 2006/091491 | A | 8/2006 |

* cited by examiner

STAPLER

BACKGROUND

1. Field

Aspects of the invention relate to fastener applicators, such as staplers, and to desktop staplers.

2. Discussion of Related Art

Fastener applicators, such as staplers, are capable of driving at least one fastener into a desired target object. Some fastener applicators are spring-biased in that they utilize the energy stored in a spring to drive the staple into the target object. Aspects of the invention are directed to improved staplers.

SUMMARY

One illustrative embodiment is directed to a desktop stapler. The stapler has a body, a strike plate movably mounted to the body between a rest position and a loaded position, and adapted to drive a staple, and a leaf spring. The leaf spring has a first, fixed portion fixedly mounted to the body and a second, free portion coupled to the strike plate. The spring is adapted to repeatedly move the strike plate from the loaded position to the rest position to drive the staple. The desktop stapler also includes a loading mechanism mounted in the body and arranged to repeatedly move the strike plate from the rest position toward the loaded position. A distance between the rest position and the loaded position is between about 0.300 inches and about 0.600 inches.

Another illustrative embodiment is directed to a desktop stapler. The stapler has a body, a strike plate adapted to drive a staple and movably mounted to the body between a rest position and a loaded position, and a leaf spring coupled to the body and cooperating with the strike plate. The leaf spring provides an output force on the strike plate when the strike plate is in the loaded position. The desktop stapler also includes a loading mechanism mounted in the body and arranged to repeatedly move the strike plate from the rest position toward the loaded position, and a handle mounted to the body and cooperating with the loading mechanism. The handle has an input location adapted to receive an input force from a user. A ratio of the output force on the strike plate when the strike plate is at the loaded position to the input force on the handle at the input location is in a range between about 2:1 and 5:1.

Yet another illustrative embodiment is directed to a desktop stapler. The stapler has a body having a staple chamber and a strike plate movably mounted to the body between a rest position and a loaded position. The strike plate is adapted to drive a staple from the staple chamber into an object. The strike plate has an opening. The stapler also includes a power spring with a plurality of leaf springs, each with a different length, clamped together. The power spring has a first, fixed end fixedly mounted to the body and a second, free end formed as a tab on a first one of the leaf springs and adapted to engage with an edge of the opening in the strike plate. The power spring is adapted to repeatedly move the strike plate from the loaded position to the rest position to drive the staple. The power spring provides an output force on the strike plate when the strike plate is in the loaded position. The power spring has a rest configuration when the strike plate is in the rest position and a loaded configuration when the strike plate is in the loaded position. The stapler also includes a loading mechanism mounted in the body that is adapted to repeatedly move the strike plate from the rest position toward the loaded position. The loading mechanism includes a lever pivotally mounted to the body at a pivot and having a first end and a second end and a trigger pivotally mounted to the second end of the lever. The trigger has a trigger foot adapted to engage with an edge of an opening in the first one of the leaf springs. The stapler also includes a handle pivotally mounted to the body. The handle has a first area adapted to engage the first end of the lever and a cam surface adapted to engage the trigger. Pivoting the handle causes the first area of the handle to act on the first end of the lever to pivot the lever such that the second end of the lever lifts the trigger toward the cam surface on the handle and thereby loads the power spring and raises the strike plate from the rest position toward the loaded position whereupon the trigger pivots relative to the lever arm to disengage from the power spring when the strike plate is in the loaded position. The stapler also includes at least one dampener mounted to the body and adapted to absorb some impact of the power spring upon return from the loaded configuration to the rest configuration.

Yet another illustrative embodiment is directed to a manual desktop stapler. The stapler includes a body having a staple chamber, a strike plate movably mounted to the body and adapted to drive a staple from the staple chamber and into a target object, and a handle pivotally mounted to the body and operatively coupled to the strike plate. Application of an input force results in movement of the strike plate relative to the body to drive a staple. The stapler further includes a lockout mounted to the body and operating in a manner to inhibit movement of the strike plate and subsequent driving a staple unless the body is adjacent to the target object.

Still another illustrative embodiment is directed to a stapler. The stapler includes a body and a strike plate movably mounted to the body between a rest position and a loaded position. The strike plate is adapted to drive a staple into a target object. A power spring is coupled to the body and cooperates with the strike plate. The power spring is adapted to provide an output force on the strike plate when the strike plate is in the loaded position. A loading arrangement is mounted in the body and is adapted to repeatedly move the strike plate from the rest position toward the loaded position. The stapler also includes a lockout mounted to the body. The lockout is adapted to inhibit loading the power spring unless the body is adjacent to the target object.

Another illustrative embodiment is directed to a stapler. The stapler includes a body and a strike plate movably mounted to the body between a rest position and a loaded position. The strike plate is adapted to drive a staple into a target object. A lockout mechanism operates in a manner to inhibit movement of the strike plate unless the body is adjacent to the target object. The lockout mechanism includes a rotatable member rotatably mounted relative to the body. The rotatable member is adapted to rotate between a first position when the body is not adjacent the target object to inhibit movement of the strike plate and adapted to rotate to a second position when the body is adjacent the target object to allow movement of the strike plate. A movable plunger cooperates with the rotatable member. Movement of the plunger causes the rotatable member to rotate between the first position and the second position.

Another illustrative embodiment is directed to a stapler. The stapler includes a body and a strike plate movably mounted to the body between a rest position and a loaded position. The strike plate is adapted to drive a staple into a target object. A lockout mechanism operated in a manner to inhibit movement of the strike plate unless the body is adjacent to the target object. The lockout mechanism includes a movable member movably mounted relative to the body. The movable member is adapted to move between a first position when the body is not adjacent the target object to inhibit movement of the strike plate and adapted to move to a second position when the body is adjacent the target object to allow movement of the strike plate. A stop block is disposed on the movable member. The stop block is adapted to prevent the movable member from returning to the first position once the strike plate moves from the rest position.

Another illustrative embodiment is directed to a stapler. The stapler includes a body and a strike plate movably mounted to the body between a rest position and a loaded position. A distance between the rest position and the loaded position defines a first distance. The strike plate is adapted to drive a staple into a target object. A lockout mechanism is movably mounted relative to the body. The lockout mechanism operates in a manner to inhibit movement of the strike plate unless the body is adjacent to the target object. The lockout mechanism includes a first portion adapted to contact the target object and a second portion operates in a manner to inhibit movement of the strike plate. Movement of the first portion relative to the body over a distance defines a second distance. The first distance is greater than the second distance.

Yet another illustrative embodiment is directed to a manual desktop stapler. The stapler includes a body having a staple chamber and a strike plate movably mounted to the body between a rest position and a loaded position and adapted to drive a staple into a target object. A handle is pivotally mounted to the body and operatively coupled to the strike plate. Application of an input force results in movement of the strike plate relative to the body to drive a staple. A power spring is coupled to the body and cooperating with the strike plate. The power spring is adapted to provide an output force on the strike plate when the strike plate is in the loaded position. A loading arrangement is mounted in the body and cooperates with the handle and the power spring. The loading arrangement is adapted to repeatedly move the strike plate from the rest position toward the loaded position upon application of the input force. A lockout mechanism is mounted to the body and adapted to inhibit loading the power spring unless the body is adjacent to the target object. The lockout mechanism includes a rotatable member rotatably mounted relative to the body a movable plunger cooperating with the rotatable member. The rotatable member is adapted to rotate between a first position when the body is not adjacent the target object to inhibit loading the power spring and movement of the strike plate and adapted to rotate to a second position when the body is adjacent the target object to allow loading the power spring and movement of the strike plate. Movement of the plunger causes the rotatable member to rotate between the first position and the second position. A stop block is disposed on the rotatable member. The stop block is adapted to prevent the rotatable member from returning to the first position once the strike plate moves from the rest position.

Various embodiments of the present inventions provide certain advantages. Not all embodiments of the invention share the same advantages and those that do may not share them under all circumstances.

Further features and advantages of the present inventions, as well as the structure of various embodiments of the present inventions are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
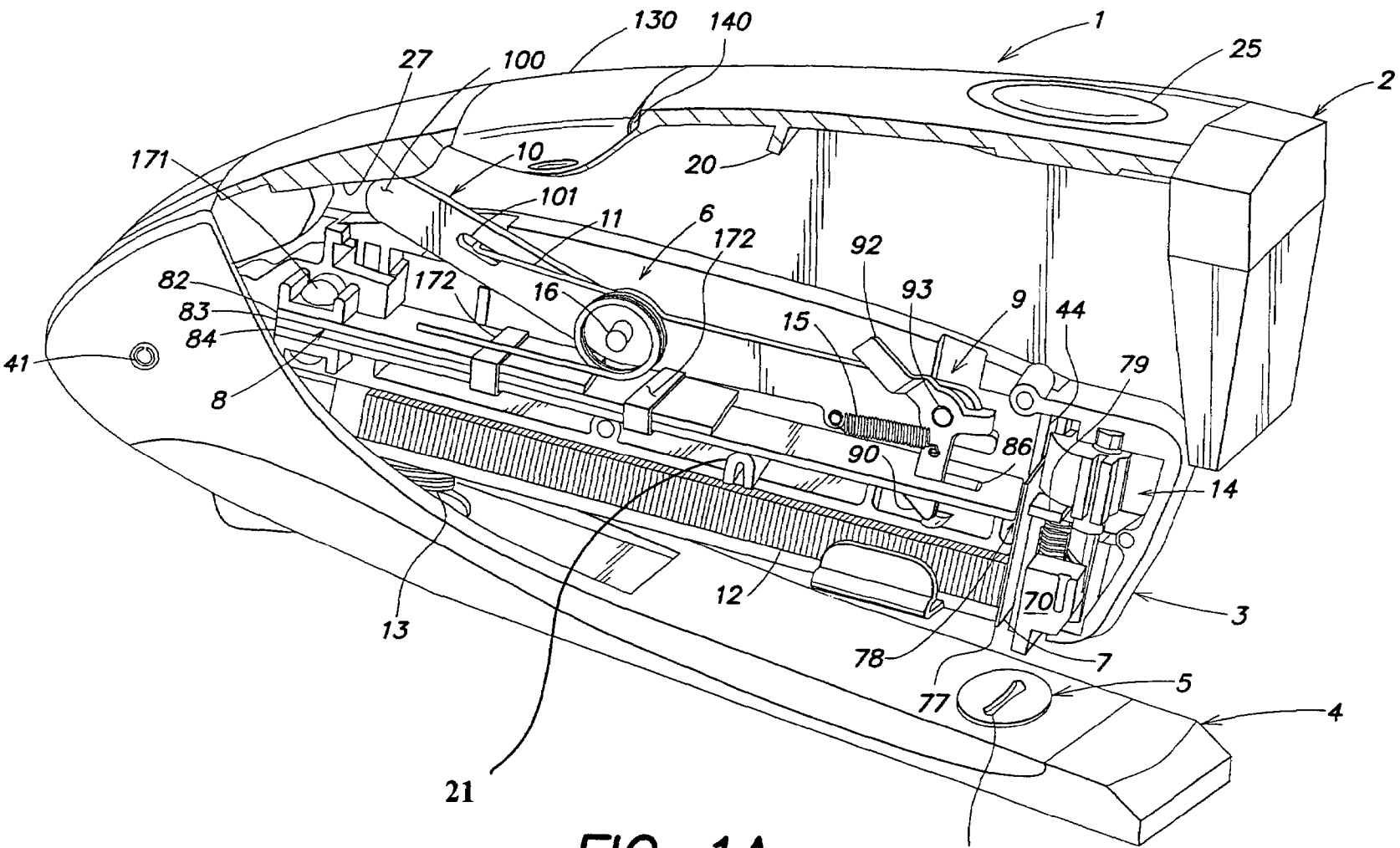
FIG. 1A is a side perspective partial cutaway view of one embodiment of a stapler.

The inventions are not limited in its application to the details of construction and the arrangement of components set forth in the following description or illustrated in the drawings. The inventions are capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

A stapler includes a body and a strike plate movably mounted to the body between a rest position and loaded position and is configured to drive a staple into a target object. The strike plate is associated with a power spring such that as the power spring is loaded, the strike plate is lifted. At a release point, the power spring and strike plate are released, driving a staple into a target object.

To load the power spring and raise the strike plate, a loading arrangement is employed. The loading arrangement includes a lever coupled to the power spring and in one embodiment via a trigger. When the trigger becomes disengaged, the power spring and strike plate are released and the strike plate drives a staple into a target object.

The power spring may be configured as a leaf spring and the stapler may be configured as a desktop stapler. In one embodiment of a desktop stapler incorporating a leaf spring, the strike plate is adapted to move a distance of between about 0.300 inches and about 0.600 inches and in one embodiment the strike plate moves about 0.400 inches. In this manner, the desktop stapler is designed such that the power spring, and in this embodiment, the leaf spring, can withstand repeated deflection of the magnitude required to move the strike plate without incurring undue stress. Further, in one embodiment, a desktop stapler incorporating a leaf spring can produce a resultant stapling force that is between about 2:1 and about 5:1 of output force to input force. In one embodiment, the ratio of output force to input force is about 2.25:1 in a desktop stapler incorporating a leaf spring.

To inhibit a stapler from inadvertently discharging a staple, a lockout arrangement may be employed. The lockout arrangement can be configured in any suitable manner and cooperate with a manual desktop stapler or a stapler including a power spring. In one embodiment of a stapler incorporating a lockout, whether desktop or otherwise and whether or not the stapler includes a power spring, the lockout is configured such that relatively little movement of one portion of the lockout allows significant clearance to allow the strike plate to move over its intended travel distance. In one embodiment, the lockout includes a rotatable member that can rotate out of the way to allow strike plate movement. In one embodiment, the lockout has a feature configured to prevent the lockout from moving back into a strike plate movement inhibiting position after a stapling operating begins.

Figure 1B:
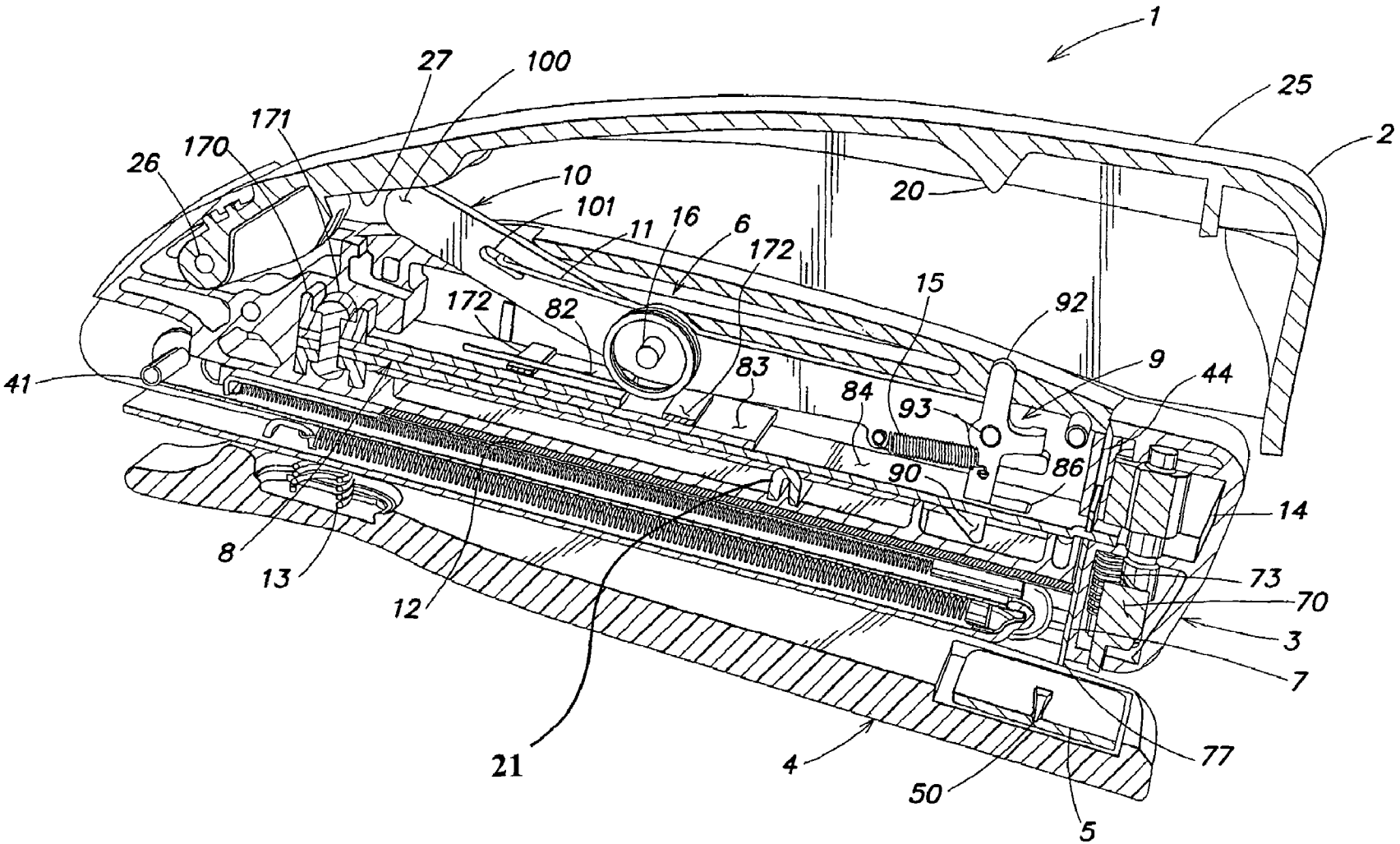
FIG. 1B is a side perspective partial cutaway view of another embodiment of a stapler.

Illustrative embodiments of the stapler will now be described, with reference to the figures. As shown in FIGS. 1A and 1B, which show two similar embodiments of the stapler, the stapler 1 comprises a handle 2, body 3, and base 4. An anvil 5 is located on the base 4. The body 3 houses at least a portion of a loading mechanism 6 (which includes a lever 10, as will be explained hereafter) and staple chamber 12. In one embodiment, a lockout mechanism 14 to inhibit the stapler 1 from firing under some conditions may also be located in the body 3. The stapler 1 may be configured to stably rest on a flat surface such as a desk or table top. The stapler 1 may additionally or alternatively be configured to rest comfortably in a user's hand, such as with a user's palm against the handle 2 and fingers wrapped around to contact the base 4. Although the stapler includes a base, it should be appreciated that the present invention is not limited in this respect, as a base need not be included.

The handle 2 may be configured for rotational movement with respect to the body 3. One end of the handle 2 may be pivotably connected through a pin 26 (see FIG. 1B) to the body 3. The other end may be free to rotate around the handle pin. The pin may be formed of steel, plastic, and/or another material strong enough to withstand the forces applied to it without substantially bending, cracking, or failing. The pin may be a separate component or integrally formed to the handle or body, as the present invention is not limited in this respect.

The handle 2 may comprise a metallic alloy to provide the desired strength and weight characteristics. For example, the handle 2 may comprise an alloy such as Zamak. Alternatively or additionally, the handle 2 may comprise a polymer such as ABS or polycarbonate. Other suitable materials may be employed, as the present invention is not limited in this respect.

In one embodiment, the handle 2 receives a user input force. The handle 2 comprises an input location 25 configured to receive an input force from a user, such as a user pressing down on the input location with a finger or a palm of a hand. The input location 25 may be located anywhere on the upper side of the handle 2, although those of skill in the art will appreciate that the farther from the handle pivot, the longer the lever arm will be, and the easier the handle 2 will be to move. The input location 25 may be contoured to comfortably receive any desired portion of a user's hand. The input location 25 may be marked by a surface contour (such as an indentation and/or raised portion as shown in FIG. 1A), another material, color, or any other indicia.

The handle 2 may also comprise a loading mechanism engaging surface 27. The loading mechanism engaging surface 27 may provide a surface for one end of the lever 10 of the loading mechanism to contact as the handle 2 is depressed. The loading mechanism engaging surface 27 may be contoured to cause the lever 10 to rotate about its pivot point 16. As the handle 2 is depressed, the loading mechanism engaging surface 27 contacts one end of the lever 10 and pushes it downward, causing the lever 10 to pivot about its pivot point 16.

In one aspect, the loading mechanism engaging surface 27 may be configured to resist repeated abrasion and/or wear by the lever 10. In one embodiment, the handle 2 comprises a relatively hard wear-resistant material. Alternatively or additionally, the loading mechanism engaging surface 27 may comprise a low friction material. A low friction material may reduce the wear on the lever 10 and/or the loading mechanism engaging surface 27. Alternatively or additionally, the loading mechanism engaging surface 27 may be coated, covered, or embedded with a hard wear/abrasion-resistant and/or low friction material. Of course, the present invention is not so limited, and the loading mechanism engaging surface 27 may not have such wear/abrasion resistant properties.

The handle 2 may additionally comprise a cam 20. The cam 20 may be an extension of the handle material as shown in FIGS. 1A and 1B. Alternatively, the cam 20 may comprise a different material than the handle and/or may be manufactured separately from the rest of the handle 2. In one embodiment, the cam 20 may be strengthened to withstand the forces and wear associated with repeated stapling operations. The cam 20 may comprise a strong and/or hard material, be coated or covered by a strong and/or hard material, have a strong and/or hard material embedded in it, or any other configuration that provides strength to the cam 20. As with the loading mechanism engaging surface 27, the cam may not be so configured, as the present invention is not limited in this respect.

The base 4 comprises an anvil 5 configured to receive and shape a fastener that has penetrated a target object. The anvil 5 comprises at least one staple receiving area 50 configured to bend the legs of a staple after it penetrates the target object. The anvil 5 may comprise a relatively hard material, such as 300 series stainless steel. A relatively hard material may provide a firmer surface to shape the legs of the staple and prevent the staple from puncturing or otherwise marring the anvil 5. Additionally or alternatively, the anvil 5 may be of any material that will not break or significantly degrade by repeated hammering of a staple.

Although the anvil 5 of FIG. 1 has an oval perimeter, the anvil 5 may be square, rectangular (as shown in FIG. 1B), circular, or any other shape. The shape of the perimeter may be chosen to have the desired strength and/or aesthetic characteristics. Also, although not shown, the anvil may be interchangeable with other shaped anvils.

In one embodiment, the base 4 is pivotably connected to the body 3. The base 4 is connected to the body 3 at one end through a base pivot 41. The base 4 and body 3 have a rest configuration as shown in FIGS. 1A and 1B. The base 4 and body 3 may normally retain the rest configuration due to the action of a base spring 13 and the interface between detent D (see FIG. 3) and groove (not shown). The base spring 13 biases the body 3 away from the base 4. The base spring 13 shown in FIGS. 1A and 1B is a coil spring, but any other spring configuration, such as a leaf spring or a torsion spring, may additionally or alternatively be used. By biasing the body 3 away from the base 4, the base spring 13 provides a place for a user to place a target object, such as a plurality of papers. Of course, the present invention is not limited in this respect, as the body and base need not be biased relative to one another.

A detent/groove interface may be configured to keep the base in proximity to the body so that the base spring 13 is under slight compression. The base 4 may have a protrusion D (see FIG. 3) that rides in a groove (not shown) located in the body 3. The protrusion is small enough so that a user can pull the base 4 away from the body 3 with a relatively small amount of force. However, the detent/groove interface prevents the base spring 13 from rotating the body 3 away from the base 4. Although the embodiment shown in FIG. 3 includes a detent on the base, the present invention is not limited in this respect, as the detent may be on the body and the groove on the base.

The base 4 may be formed of a material comprising a polymer such as a polycarbonate, ABS, or combinations of polymers. Alternatively, the base may be formed of a metal or metallic alloy such as Zamak. The base 4 may comprise an elastomeric material on the side opposite the anvil to provide friction sufficient to reduce slippage of the stapler. Other suitable materials for the base may be employed, as the present invention is not limited in this respect.

The base may be formed with a generally planar support surface that is adapted to be placed on a table or desk. In addition, a cushioning material may be adhered, molded (e.g., so-molded or overmolded) onto or otherwise disposed on the desktop/tabletop facing surface.

The body 3 may at least partially house the loading mechanism 6 and staple chamber 12. The body 3 may comprise a metallic material such as zinc or a metallic alloy such as Zamak. The body 3 may comprise a harder material than the base 4 and handle 2 in order to withstand the forces applied to it during the stapling operation. The body 3 may be formed from a plurality of pieces (such as left and right halves) or it may be formed as a unitary construct.

As noted above, the stapler includes an arrangement for biasing the power spring so that the stapler can discharge a staple. In one embodiment, as noted, the stapler includes the loading mechanism 6 comprising a lever 10. The lever 10 may be rotatably attached to the body 3 at a lever pivot point 16. In one embodiment, the lever 10 is formed of a relatively hard material, such as 300 series stainless steel. The lever 10 may additionally or alternatively comprise any other material that is sufficiently strong to withstand the forces applied to it during repeated stapling procedures.

A return spring 11 may bias the lever 10 to a rest position shown in FIG. 1. Although the return spring 11 is depicted as a torsion spring, the return spring 11 may be a coil spring, leaf spring, or any other type of spring, as the present invention is not limited in this respect. In one embodiment, the lever 10 includes a hole 101 through which one end of the return spring 11 is inserted. Alternative interfaces between the return spring 11 and lever 10, such as notches, slots, and hooks, may also be used. The other end of the return spring 111 may be attached to the body 3. As shown in FIG. 1, the end of the spring 11 may be placed on a power spring 8 that is fixedly connected at one end to the body 3. Alternatively, the ends (or other suitable locations) of the return spring may be placed against an edge of the lever 10 and body, such that no notches, openings, etc. are employed as the present invention is not limited in this respect. By coupling the return spring in such a manner, the return spring 11 is loaded whenever the lever 10 rotates with respect to the body 3 to thereby provide the necessary return bias.

The lever 10 has a lever contact portion 100 at one end configured to contact the handle 2 during operation of the stapler 1 as described above. The lever contact portion 100 may be configured to reduce wear on the handle 2. In one embodiment, the lever contact portion 100 is coated to reduce the wear on the loading mechanism engaging surface 27. The lever contact portion 100 may additionally or alternatively have a smooth finish. In addition, or in the alternative, the lever contact portion may include a large surface area, such as by bending the end perpendicular to the lever, to reduce the wear on the handle. Of course, the present invention is not limited in this respect, as means to reduce the wear need not be employed.

The loading mechanism may also include a trigger 9 to releasably engage the power spring. In this regard, as the lever pivots, the trigger, being engaged with the power spring, lifts the power spring to a loaded configuration. In one embodiment, the trigger 9 is pivotably attached to the lever at the end opposite the lever contact portion 100. A rivet 93 may connect the trigger 9 to the lever 10. The rivet 93 may be a straight rivet, shoulder rivet, or any other configuration. The trigger 9 may comprise a relatively hard material such as tempered spring steel in order to withstand the forces placed upon it during repeated stapling operations.

A trigger spring 15 may be employed to bias the trigger into engagement with the power spring. The trigger spring 15 may attach to the lever 10 at one end and the trigger 9 near the trigger foot 90 at the other end. Although the trigger spring 15 is depicted as coil spring in FIG. 1, a torsional spring or any other type of spring could be used.

The trigger 9 in FIG. 1A has an angular configuration (i.e., from a side view, where a trigger contact portion 92 is at an angle relative to the trigger foot 90). However, alternative trigger configurations could be used. For example, the trigger 9 could be substantially straight, as shown in FIG. 1B, as the present invention is not limited in this respect.

In one embodiment, the trigger 9 includes a trigger foot 90 at one end. The trigger foot 90 is configured to releasably engage the power spring, as will be described below. The trigger foot 90 may have alternative configurations as well. The trigger foot 90 may be substantially triangular as shown in the figures although other suitable shapes may be employed, as the present invention is not limited in this respect.

The end of the trigger opposite the trigger foot 90 comprises a trigger contact portion 92. The trigger contact portion 92 is configured to contact the cam 20 in such a way as to cause the trigger to rotate and overcome the bias of spring 15 to disengage the trigger 9 from the power spring 8. The trigger and/or trigger contact portion 92 may comprise characteristics to reduce wear on the cam. For example, the trigger 9 and/or trigger contact portion 92 may be coated with a material to increase the life of the stapler 1. However, the trigger contact portion 92 need not be so configured, as the present invention is not limited in this respect.

Figure 2:
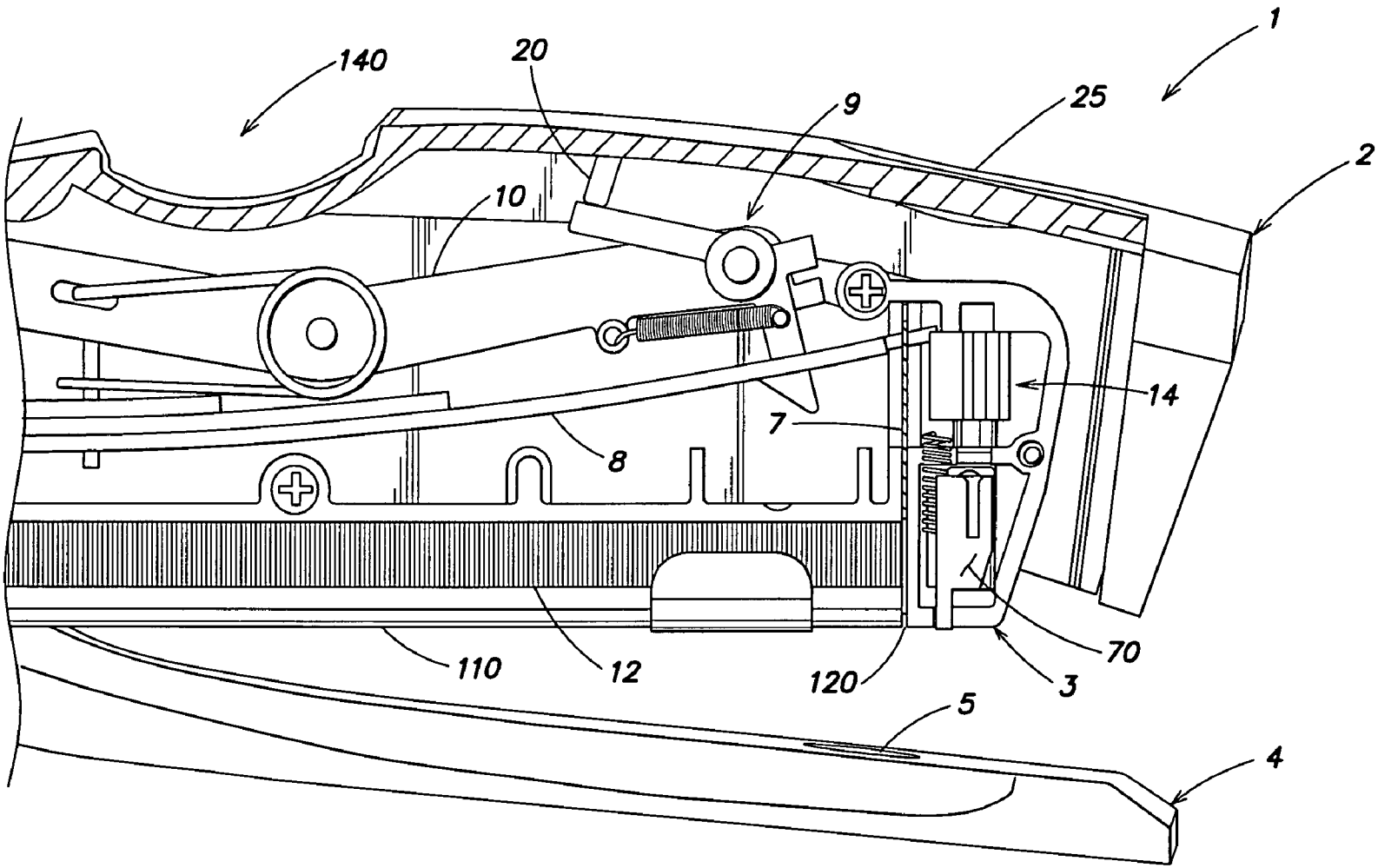
FIG. 2 is a side perspective cutaway view of the front portion of the stapler of FIG. 1A in the loaded configuration.

As noted above, the stapler also includes a power spring 8. In one embodiment, the power spring 8 is configured to repeatedly move a strike plate 7 up and down between the configurations shown in FIGS. 1A and 1B and FIG. 2. The power spring 8 may store energy that is used to force a fastener through a target object. In one embodiment, the power spring 8 comprises a leaf spring. One end of the leaf spring is fixedly mounted to the body 3 of the stapler 1. The other end of the spring 8 is free to deflect substantially vertically. The free end of the power spring 8 may be configured to engage the strike plate 7. The free end of the power spring may terminate in a tab as shown in FIGS. 1A, 1B and 2. The power spring 8 may alternatively or additionally comprise a hook, slot, hole, clamp, or any other configuration that can engage the strike plate 7, as the present invention is not limited in this respect.

The free end of the power spring may also interface with the trigger 9. In one embodiment, the free end of the power spring comprises a slot 86 to removably engage the trigger foot 90. The slot 86 is configured to provide clearance for the trigger foot 90 to rotate in and out of the slot 86. The trigger foot 90 engages one edge of the slot so that the trigger 90 and the free end of the power spring 8 move vertically in unison.

The trigger 9 shown in the figures disengages the power spring 8 by rotating about a substantially horizontal axis. Other methods of engaging and disengaging may be employed, as the present invention is not limited in this respect. For example, the loading mechanism may slide, rotate about a substantially vertical axis, or move in any other manner that would selectively permit the power spring 8 to move. In addition, alternative embodiments of the loading mechanism are also possible, as the present invention is not limited in this respect. For example, the loading mechanism could act directly on the strike plate 7 instead of interfacing the power spring 8. In other words, the lever could releasably attach the strike plate 7 or some other portion of stapler 1 with or without a trigger 9 instead of the power spring 8.

The power spring 8 may be a single spring or a plurality of springs. In one embodiment of the present invention, the power spring 8 comprises a plurality of leaf springs 82-84. The leaf springs 82-84 may be of different lengths, as shown in FIGS. 1A and 1B. The springs 82-84 are configured to provide a spring 8 with varying flexibility and/or stiffness along its length.

Although FIGS. 1A and 1B depict three stacked leaf springs 82-84, any number of springs may be used. The springs may be of any length to achieve the desired spring stiffness. Two or more springs may be relatively close in length. In one embodiment, the spring(s) each comprise 1095 blue tempered steel. However, one or more springs may comprise a different material.

In one embodiment, where a plurality of springs is used, the springs may be connected together with various clamp-like holders, such as a rivet 171, clamp 170, and/or band 172 to allow the individual leaf springs to function similar to a single spring.

In one embodiment, a clamp 170 and rivet 171 assembly may be employed to align the plurality of springs and/or attach the springs to the body, whereas the bands may be employed to hold the springs in relative proximity to one another. Other types of holders may also be used, as the present invention is not limited in this respect. The holder(s) may comprise a strong material, such as steel. The holder(s) must be strong enough to withstand repeated stresses during the stapling process, not significantly impede the flexure characteristics of the power spring 8, and/or retain the springs' alignment.

As shown in the figures, in one embodiment where a plurality of clamped springs is used, only one of the springs interfaces with the trigger 9 and/or strike plate 7. However, the present invention is not limited in this respect as the trigger 9 and/or strike plate 7 may interface with more than one leaf spring.

Although the embodiments shown in the figures depict the bottom spring as the one engaging the strike plate 7 and/or trigger 9, in other embodiments a different spring may engage the trigger 9 and/or strike plate 7. For example, the plurality of springs 82-84 may be stacked such that the longest leaf spring 84 is in the middle and the longest spring 84 engages the trigger 9 and/or strike plate 7. Alternatively or additionally, one of the springs may be wider to provide an interface location of the strike plate 7 and/or trigger 9.

Although the embodiments of the power spring shown in the figures have three discrete values for spring stiffnesses, any number of spring stiffnesses is possible, as the present invention is not limited in this respect. Varying the width of the spring along its length also produces a spring with varying flexibility and/or stiffness along its length. A wedge-shaped spring (i.e., a spring with a triangular side view) or any other spring geometry may also be used. Further, although a leaf spring is depicted in the figures, the power spring 8 may be a torsion spring, a coil spring, or any other spring configuration, as the present invention is not limited in this respect.

As noted above, the stapler also includes a strike plate 7. In one embodiment, the strike plate 7 is slidably mounted in the body 3 so that it can slide up and down with respect to the body 3. The body 3 may be configured such that protrusions of the body 3 provide at least one guide 44 for the strike plate 7 to slide in. The guide(s) 44 may be relatively wear-resistant so as to not wear down during repeated use.

When the strike plate 7 is down as shown in FIGS. 1A and 1B, the strike plate 7 is in its rest position. When the strike plate 7 is raised as shown in FIG. 2, the strike plate 7 is in its loaded position. Similarly, when the power spring 8 carries the strike plate 7 to the raised loaded position shown in FIG. 2, the power spring 8 is in its loaded configuration and applies an output force on the strike plate 7. When the power spring 8 carries the strike plate 7 to the rest position of FIGS. 1A and 1B, the power spring 8 is in its rest configuration. However, it should be appreciated that even though the power spring 8 may be in a rest configuration, there may still be energy stored in the spring.

The strike plate 7 is designed and configured to repeatedly push a staple located in a staple chamber out of the body 3, through a target object, and to the anvil 5 in response to movement of handle 2. In one embodiment, the strike plate 7 is substantially planar and rectangular. It has a leading face 77 that is approximately the same length and width as a single staple. This provides a relatively large surface area for the strike plate 7 to push a staple with. To withstand the forces applied during the stapling process yet be the width of a single staple, the strike plate 7 comprises a relatively strong material such as tempered spring steel.

Although the strike plate shown is formed as planar component, the present invention is not limited in this respect as the strike plate may be formed in any suitable manner. Similarly, the strike plate may be formed with a straight leading face to engage the staple; however, the leading face may be curved, notched, or otherwise suitably shaped.

In one embodiment, the strike plate 7 interfaces with the power spring 8 such that movement of the power spring 8 is transferred to the strike plate 7. On a side opposite the leading face, the strike plate 7 comprises an opening 78 that fits the tab 79 on the power spring 8. Alternatively or additionally, the power spring 8 may interface with the strike plate 7 by a hook, clamp, hinge, or any other configuration that transfers movement of the power spring 8 to the strike plate 7, as the present invention is not limited in this respect.

Figure 3:
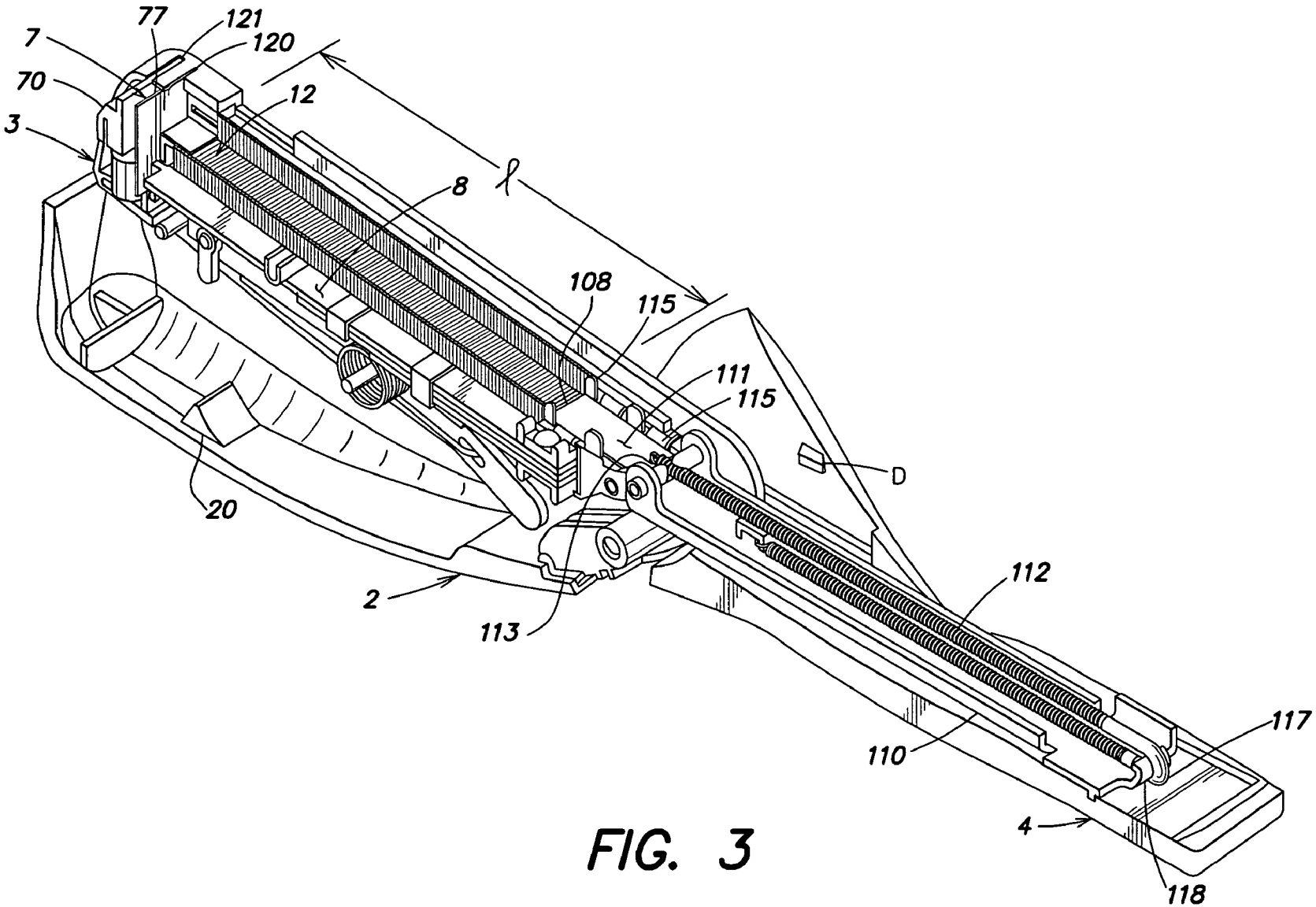
FIG. 3 is an underside perspective cutaway view of one embodiment of the stapler with the stapler in a configuration open for loading staples.

A stapler 1 according to one embodiment comprises a staple chamber 12 in the lower portion of the body 3. As shown in FIGS. 2 and 3, the staple chamber 12 comprises a staple pusher 111, a staple chamber spring 112, and a staple cover 110. The staple cover 110 holds the staples in the stapler 1 during use. In one embodiment, the staple cover 110 is pivotably connected to the body 3 at a first end of the staple cover. The other second end of the staple cover 110 is free to rotate with respect to the body 3.

Figure 4:
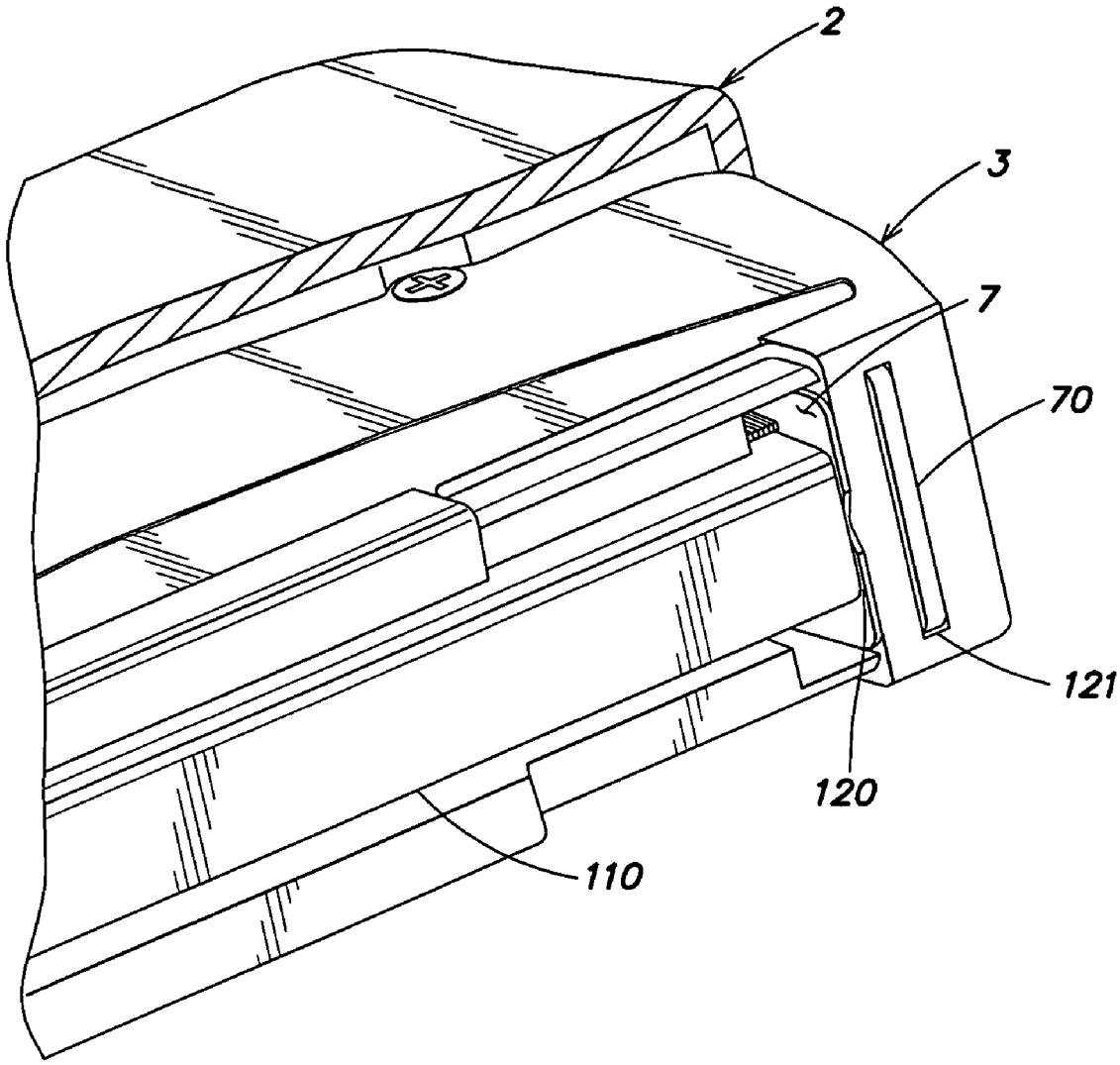
FIG. 4 is a bottom perspective view of the front portion of the stapler.

The staple cover 110 may also provide support for the staple next to the one being driven. As shown in FIG. 4, in one embodiment there is a gap 120 to permit a driven staple to exit the staple chamber. The staple cover 110 may extend to the gap 120. Thus, the staple cover 110 supports the stored staples remaining in the staple chamber 12 and does not support the driven staple being pushed by the strike plate 7. In order to prevent the staple cover from wearing down over time, it may comprise a relatively hard material, such as steel or 300 series stainless steel. The staple cover 110 may be releasably fastened to the body 3 at the second end of the staple cover 110. A latch, clamp, detent, lock, or other mechanism may fasten the free second end of the staple cover 110 to the body 3 so that the staple cover 110 can remain in the closed position during operation.

A staple chamber 12 for receiving staples protects the staples from shearing forces and keeps them aligned with the strike plate 7. The staple chamber 12 may be configured to receive an entire stack of staples. The staple chamber 12 may also be configured to support at least almost the entire height of a staple.

The staple pusher 111 is configured to push at least one staple toward the strike plate 7. In one embodiment, the staple pusher 111 at least partially rides in the staple chamber 12 and/or the staple cover so that the staple pusher 111 is aligned with the strike plate 7. In one embodiment, legs 115 are used to position the staple pusher 111 in a suitable orientation. As shown in FIG. 3, the legs 115 may be substantially vertical and/or substantially horizontal. The legs 115 may be used to laterally position the staple pusher 111 and ensure that the staple pusher 111 retains proper alignment with the strike plate 7.

In one embodiment, the staple pusher 111 has a leading edge 108 with a substantially "U" shaped cross section. The leading edge of the staple pusher 108 is configured to abut the last staple (i.e., the one farthest from the strike plate 7) in the staple chamber 12. The dimensions of the leading edge of the staple pusher 108 may approximate the dimensions of a staple. The legs of the "U" may have the same length as the staple legs, and the bight on the "U" may be substantially the same width and at approximately the same height as the staples in the staple chamber 12.

The staple pusher 111 may comprise an attachment point 113 for the staple chamber spring 112. As shown in FIG. 3, in one embodiment, the attachment point 113 comprises a ring through which one end of the staple chamber spring 112 is anchored. Other attachment configurations are also possible, as long as they provide an interface between the staple chamber spring 112 and the staple pusher 111. Although the attachment point 113 in FIG. 3 is bent from a substantially horizontal plane to a substantially vertical plane, any orientation may be used.

A staple chamber spring 112 may be used to bias the staple pusher toward the strike plate 7 when the staple cover 110 is closed and/or retract the staple pusher 111 when loading staples. In one embodiment, the staple chamber spring doubles back on itself as shown in FIGS. 1B and 3. One end of the staple chamber spring 112 is attached to the staple pusher 111, and the other end of the staple chamber spring is attached to the first end of the staple cover 110 near the pivotable connection to the body 3. The staple chamber spring 112 is bent around a spring holder 118. The spring holder 118 may comprise a protective covering near the bend 117 so that the staple chamber spring 112 does not kink or get caught on the spring holder 118. In this configuration, the spring 112 may pivot with the staple cover 110 as shown in FIG. 3. The doubled back configuration of the staple chamber spring 112 may additionally increase the stapler pusher 111 travel.

Figure 5:
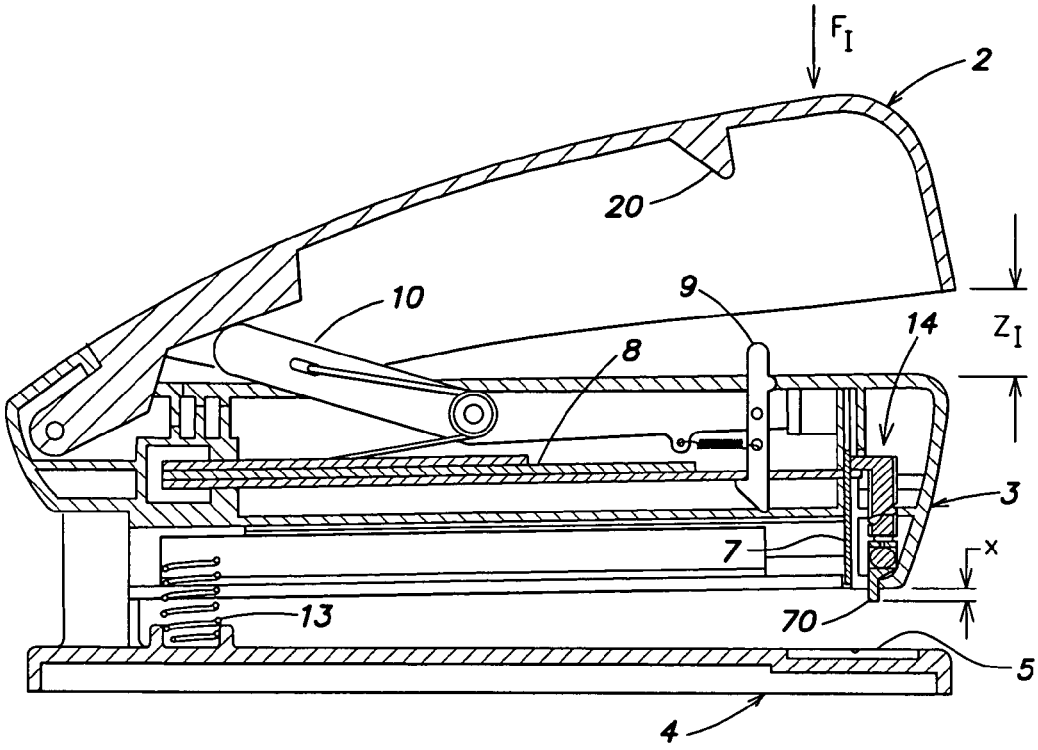
FIG. 5 is a side cutaway view of one embodiment of the stapler in a rest position.
Figure 6:
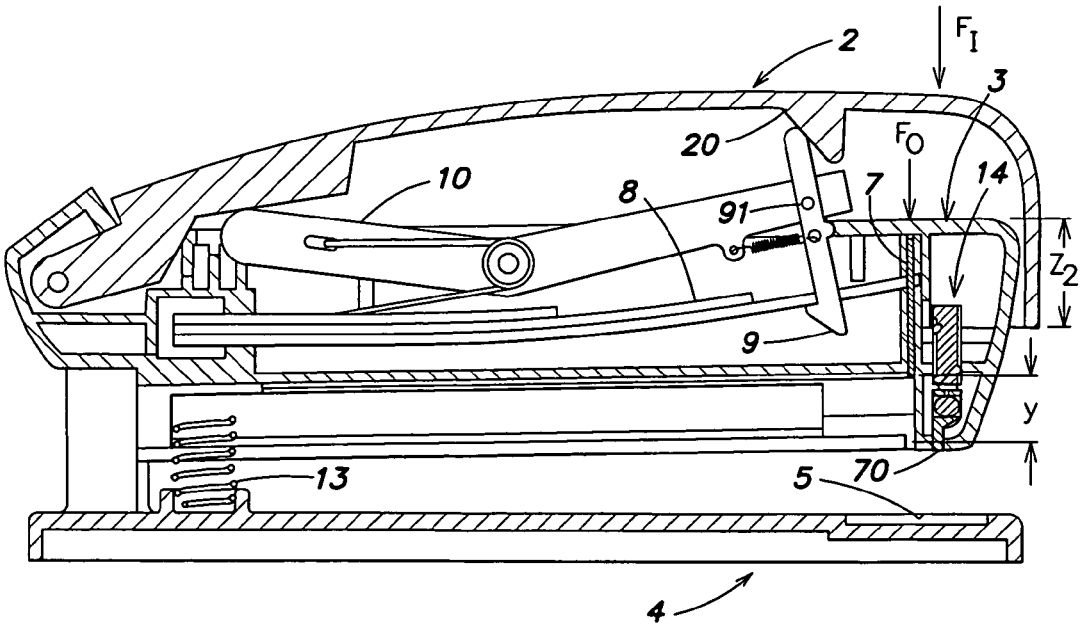
FIG. 6 is a side cutaway view of the stapler of FIG. 5 in a loaded configuration.

In some applications, it may be desirable to require a relatively small movement of the handle in order to discharge a staple from the stapler. The distance $z_1$ of FIG. 5 is the distance that the handle 2 travels to align the bottom of the handle 2 with the top of the body 3. In one embodiment, the distance $z_1$ is 0.55 inches. The distance $z_2$ of FIG. 6 is the distance the handle 2 moves beyond the top of the body 3 to dispense a staple. In one embodiment, the distance $z_2$ is 0.70 inches. The sum z of $z_1$ and $z_2$ is the total distance the handle 2 travels to dispense a staple. The strike plate 7 moves through a strike plate distance y (see FIG. 6) to separate the leading staple from the remainder of the staples (if any) and drive it through a target object such as a stack of papers. The strike plate distance y is preferably greater than the height of the staples in the staple chamber so that the strike plate 7 can clear the staples before firing. For example, the distance y may be between about 0.300 and 0.600 inches. The distance y could also be between 0.350 and 0.500 inches. In one embodiment, the distance y is about 0.400 inches. In one embodiment of the present invention, the ratio of the distance z the handle travels to the distance y the strike plate 7 moves may be less than 4:1. In another preferred embodiment, the ratio of the distance z to the distance y is less than 3.5:1 or less than 3.2:1. The ratio of the distance z to the distance y may be 3.12:1 or less.

The stapler may be designed to require relatively little user force to dispense a staple. A user may provide an input stapling force $F_I$ on the handle 2 of the stapler 1 normal to the base (see FIG. 1A). The strike plate 7 may push the leading staple with a strike plate force $F_O$. In one embodiment, the ratio of the strike plate force $F_O$ to the input force $F_I$ may be in a range between about 2:1 and 5:1. In one embodiment, the ratio of the strike plate force $F_O$ to the input force $F_I$ is in a range between about 2:1 and 4:1. In one embodiment, the ratio of the strike plate force $F_O$ to the input force $F_I$ is 2.25:1.

In one embodiment, the output force $F_O$ is in a range between approximately 20 lbf and approximately 30 lbf. In another embodiment, the output force $F_O$ is in a range between approximately 20 lbf and 25 lbf. In another embodiment, the output force $F_O$ is approximately 20.2 lbf.

Figure 7A:
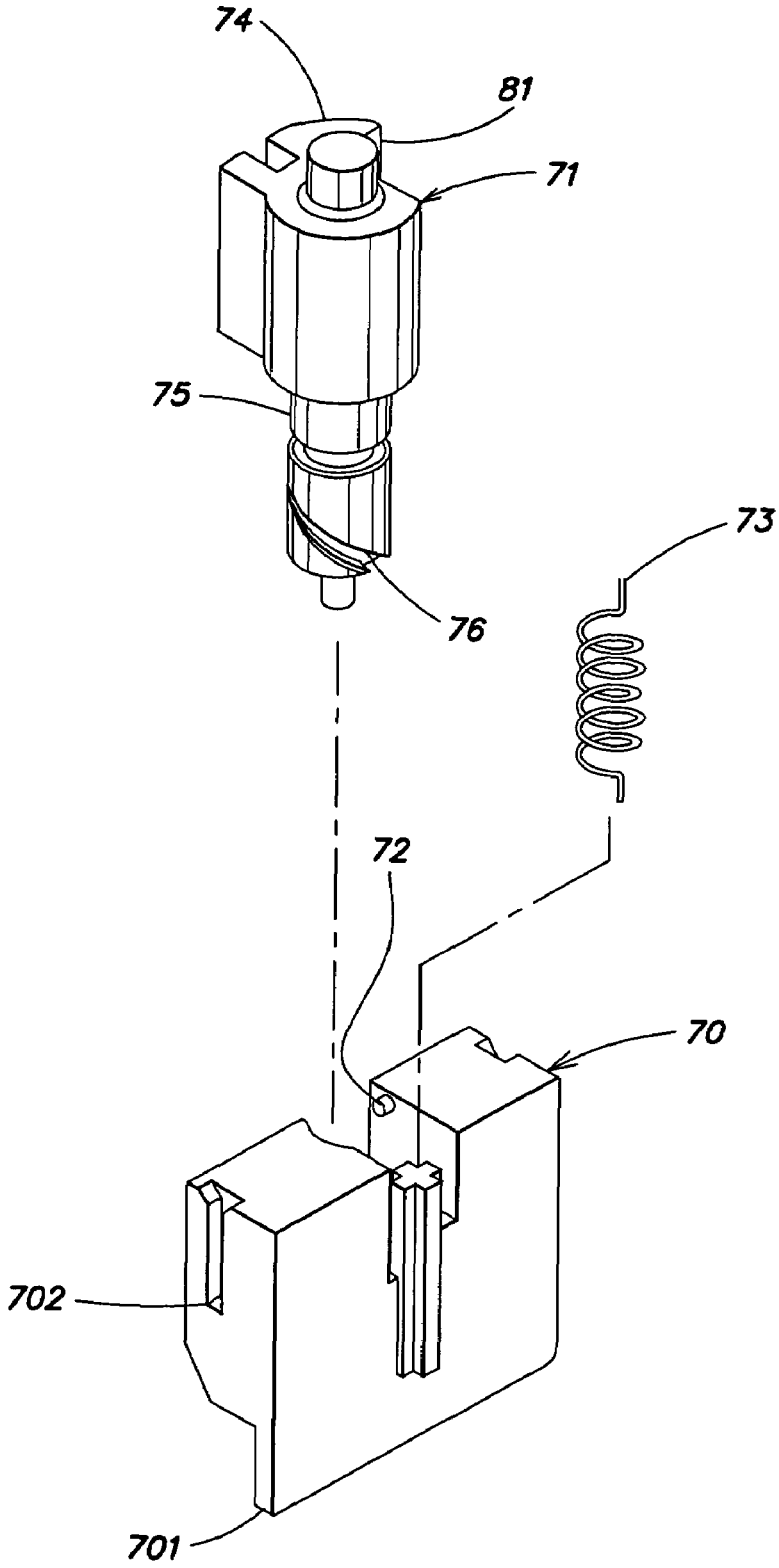
FIG. 7A is an exploded perspective view of one embodiment of a lockout.
Figure 7B:
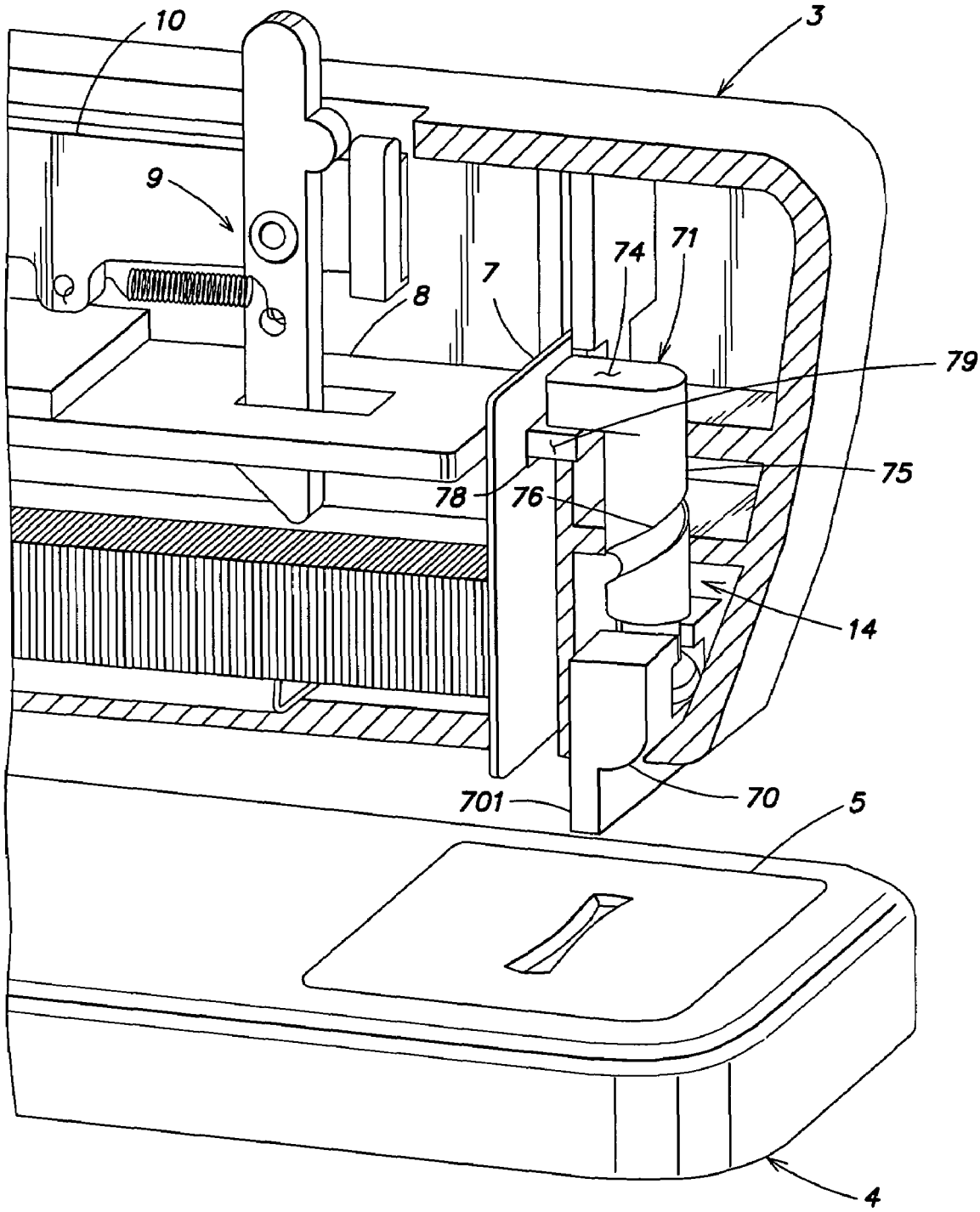
FIG. 7B is a side perspective cutaway view of one embodiment of a lockout shown in a first position.
Figure 7C:
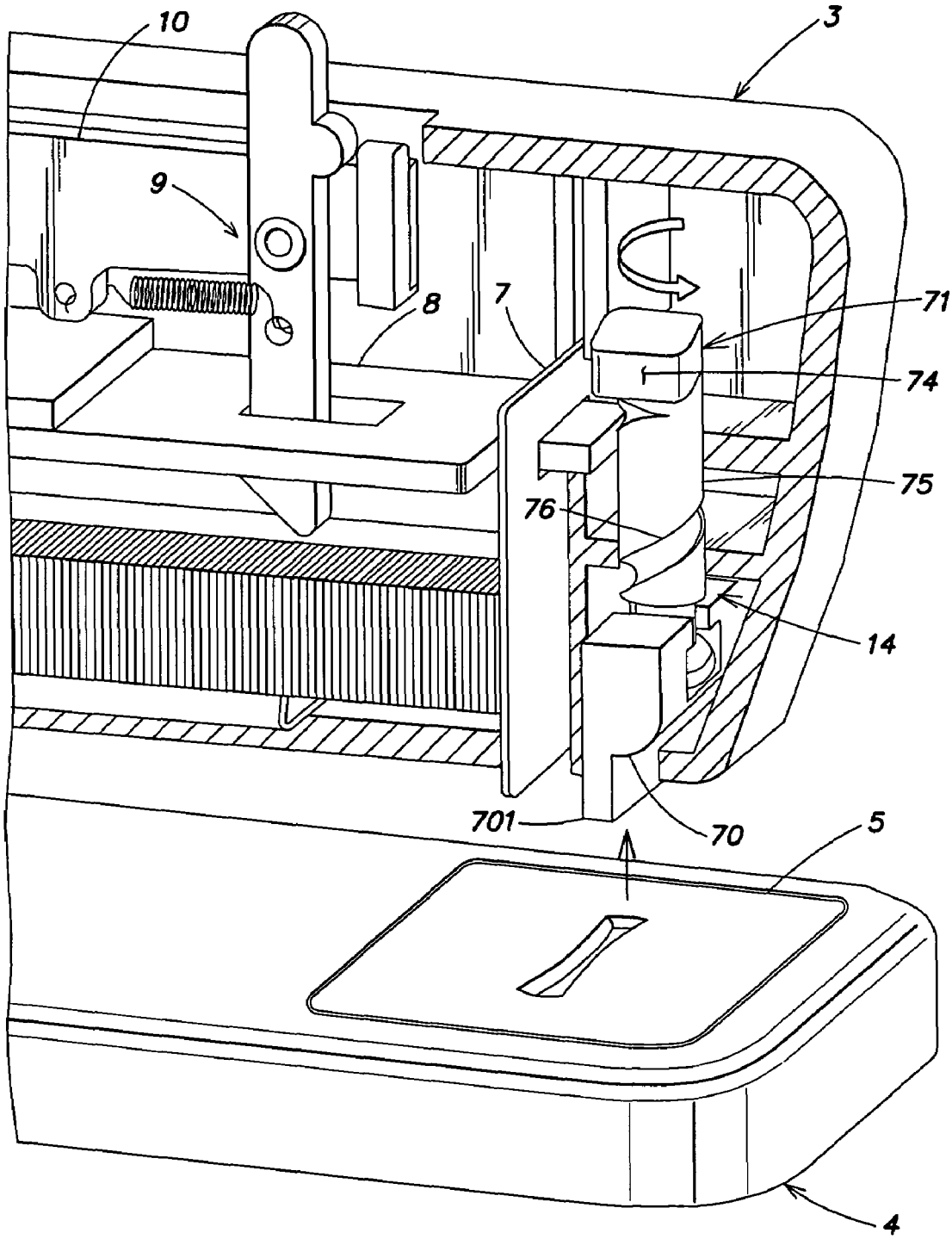
FIG. 7C is a side perspective cutaway view of one embodiment of a lockout shown in a second position.

In one embodiment and as best shown in FIGS. 7A-7C, the stapler 1 may comprise a lockout 14 that inhibits the stapler 1 from firing unless a target object is adjacent the body 3. The lockout 14 may comprise a plunger 70 to ascertain whether a target object is adjacent to the body 3. The plunger 70 is slidably mounted in the body 3 so that an upward force on the plunger 70 retracts the plunger 70 into the body 3 as shown in FIG. 7C. The plunger 70 may comprise at least one track 702 (see FIG. 7A) to permit linear movement of the plunger with respect to the body. The track 702 may be coupled to at least one protrusion in the body 3 (not shown). The protrusion(s) may maintain plunger alignment as the plunger 70 moves vertically in response to an upward force on the plunger 70. Of course, other suitable alignment arrangements may be employed, as the present invention is not limited in this respect.

In one embodiment, the plunger 70 protrudes at least in part from the boundary of the body 3 through a slot 121 in the bottom of the body 3 as best shown in FIG. 3. As shown in FIG. 7A, the plunger 70 comprises an end portion 701. A plunger spring 73 biases the plunger 70 such that the end portion 701 protrudes from the body 3.

As shown in FIG. 7, the plunger 70 may be operably connected to a lockout body 71 so that when the plunger 70 is displaced, the lockout body 71 moves to permit loading the power spring 8. In one embodiment of the lockout 14, the lockout body 71 comprises a movable member and a stop block 74 where the movable member is rotated to permit movement of the strike plate 7. The movable member comprises a rod 75 formed with helical groove 76 thereabout. The stop block 74 is fixed to the movable member and radially extends beyond the rod 75. The stop block 74 has a first position where the stop block 74 inhibits movement of the strike plate 7 by extending over and at least partially blocking the movement of the power spring 8, as shown in FIG. 7B. The rod 75 is rotatably connected to the body 3 such that it is free to rotate around its longitudinal axis. The helical groove 76 mates with a pin 72 (see FIG. 7A) on the plunger 70. The pin 72 on the plunger may be located on the end opposite the end portion that is configured to contact a target object. Thus, as the plunger 70 retracts into the body 3, the pin 72 slides in the helical groove 76, causing the rod 75 to rotate. Rotation of the rod 75 rotates the stop block 74 to a second position where the strike plate is permitted to move with respect to the body 3, as shown in FIG. 7C.

In one embodiment, movement of the plunger 70 a release distance x (see FIG. 5) toward the body is sufficient to release the lockout 14. In one embodiment, movement of the plunger over the release distance x is less than the distance that the strike plate moves between the rest position and the loaded position. In one embodiment, the distance x is about 0.100 inches. In another embodiment, the distance x is about 0.080 inches.

Although the embodiment depicted in FIGS. 7A-7C utilizes a rod 75 with a helical groove 76, other embodiments for the interface between the plunger 70 and lockout body 71 are possible, as the present invention is not limited in this respect. For example, a lever or linkage system may connect the plunger 70 to the lockout body 71. In addition or as an alternative to the plunger spring 73, the lockout 14 may comprise a spring which biases the lockout body 71 into the engaged position so that the stapler 1 is normally prevented from firing. For example, a torsion spring coaxial to the lockout body 71 may bias the lockout body 71 toward the locked configuration (not shown).

In one embodiment of the present invention, the lockout body 71 comprises a stop 81 (see FIG. 7A) arranged normal to the tab 74 and configured to prevent the tab 74 from reengaging the power spring 8 prematurely. When the firing condition is met, that is when the plunger engages a target object, the lockout 14 releases the power spring 8. Once the free end of the power spring 8 begins to deflect, it is undesirable for the movable tab 74 to rotate back to the engaged position unless a reset condition is met. Reset conditions include when the firing condition is no longer met (e.g., no target object is adjacent to the body 3), a staple has been dispensed, or the handle 2 is not depressed.

Although the embodiments depicted in the figures comprise a stop block 74 that engages a portion of the power spring 8, other parts of the stapler 1 may additionally or alternatively be used. The strike plate 7, lever 10, or any other part of the stapler 1 may be used to contact the stop block 74 and thus prevent the lockout body 71 from rotating to the position where the strike plate 7 cannot move. In the embodiments shown in the figures, the lockout 14 inhibits the power spring from moving. Alternatively or additionally, the lockout 14 may operate to prevent another part of the stapler from moving. For example, the lockout 14 may prevent the handle 2 from moving with respect to the base. Alternatively, the lockout 14 may prevent the lever 10 or strike plate 7 from moving.

Figure 8A:
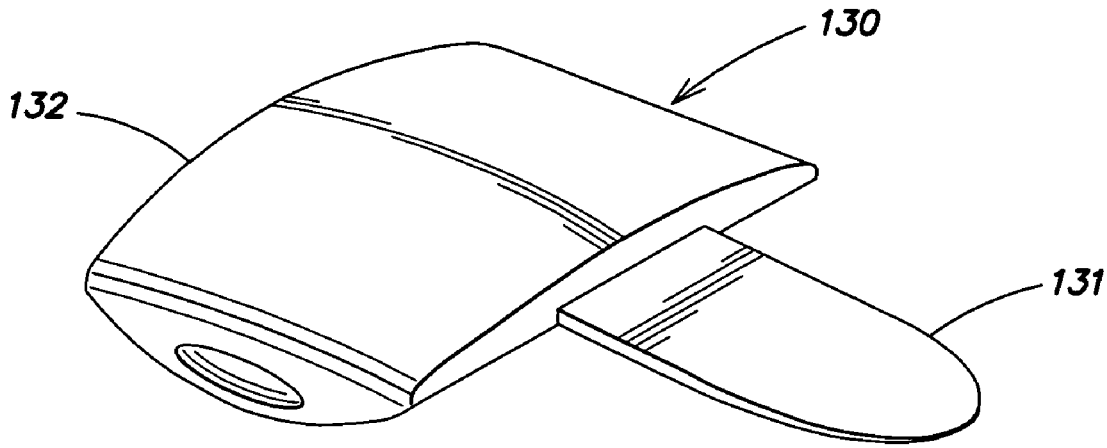
FIG. 8A is a perspective bottom view of a staple remover according to one embodiment.
Figure 8B:
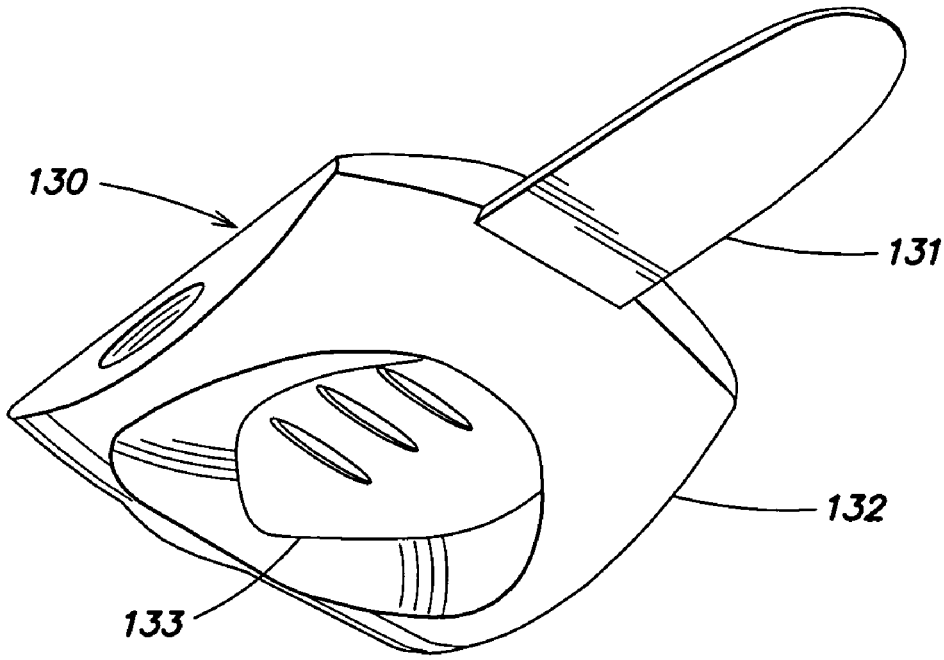
FIG. 8B is a perspective top view of the staple remover of FIG. 8A.

In another aspect of the present invention, the stapler may comprise a staple remover. As shown in FIG. 1, the staple remover 130 may be removably located in one part of the stapler. Although FIG. 1 depicts a staple remover 130 as being located towards the rear part of the stapler handle, the staple remover 130 can alternatively or additionally be located at the front of the stapler handle, in the base of the stapler, or any other part of the stapler, as the present invention is not limited in this respect. As shown in FIGS. 8A and 8B, the staple remover 130 may have a substantially flat blade 131. The blade 131 may be tapered toward one end to facilitate insertion between a staple and a target object in order to loosen the staple. The staple remover 130 includes a handle 132 to promote ease of use. The staple remover handle 132 may have a recess 133 configured to comfortably receive a thumb or other finger. In one embodiment, the staple remover 130 is configured to nest in the stapler 1 such that it does not impede or hamper use of the stapler 1. For example, as shown in FIGS. 1A and 2, the stapler 1 may have a recess 140 formed in the handle to receive the handle 132 of the staple remover 130. Also, the stapler handle 2 may include a pocket, slit or other recess adapted to receive the blade of the staple remover.

Figure 9:
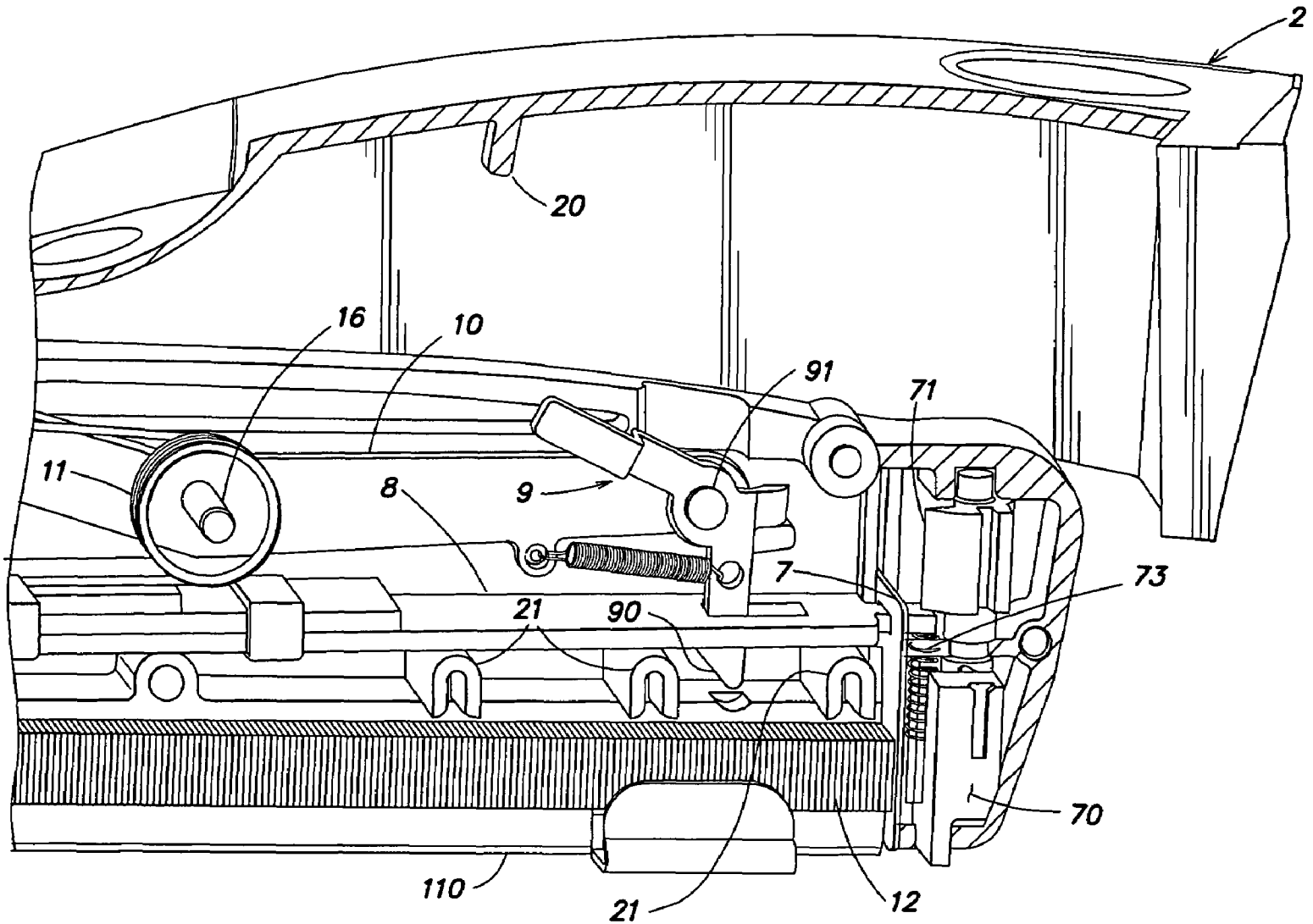
FIG. 9 is a side perspective cutaway view of the front portion of the stapler according to another embodiment.

In yet another aspect of the present invention, as shown in FIG. 9, the stapler 1 may comprise a dampener 21 to decrease the vibration and/or sound caused by the stapling mechanism. The dampener may also be used a shock absorber. For example, if the dampener 21 is placed at least partially under the flexible end of the power spring 8, the dampener 21 could provide an elastic body for the power spring 8 to hit once released by the loading mechanism. This may protect the power spring 8 from undue stress, dampen the sound produced by the stapler 1, and/or reduce the vibration of the stapler 1. The dampener 21 may comprise an elastomeric material, such as rubber, or any other suitable material to lessen the impact of the power spring.

In one embodiment, the dampener is formed as a U-shaped member mounted to the body 3. As shown in FIG. 9, in one embodiment, the stapler comprises a plurality of dampeners 21. When a plurality of dampeners 21 is used, the dampeners 21 may be spaced out along the length l (see FIG. 3) of the power spring 8.

Figure 10A:
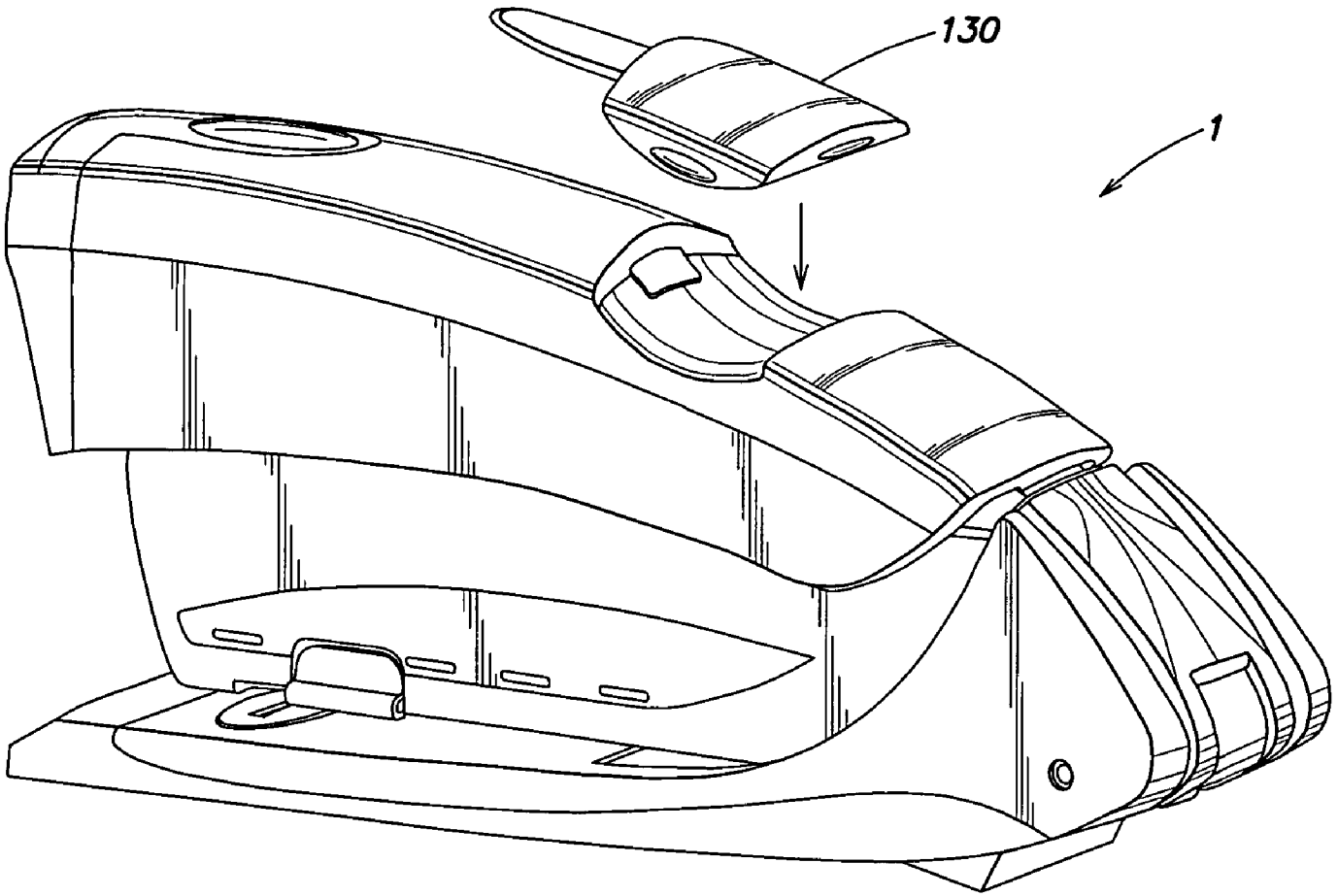
FIGS. 10A-10C are assembled views of one embodiment of the stapler.
Figure 10B:
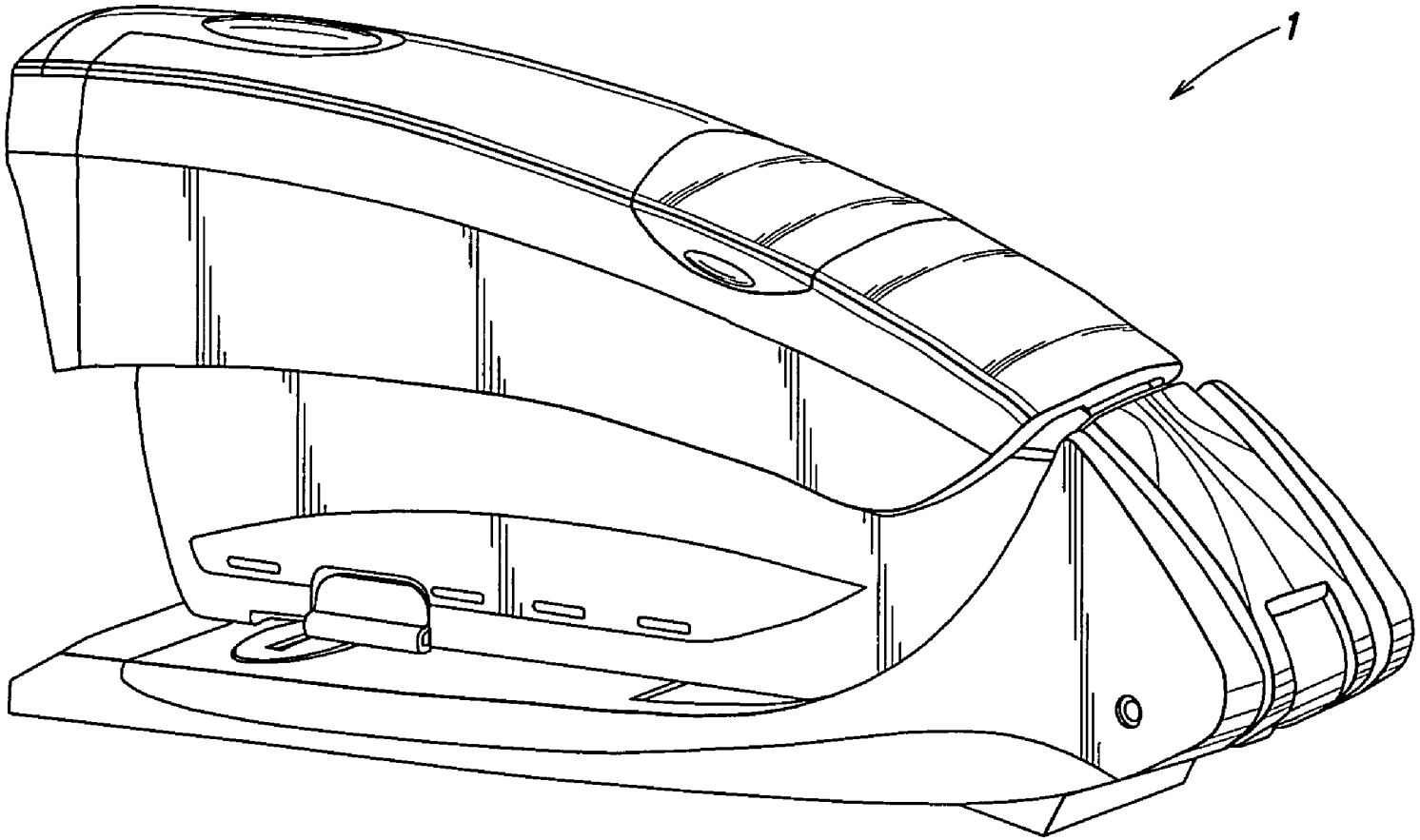
Figure 10C:
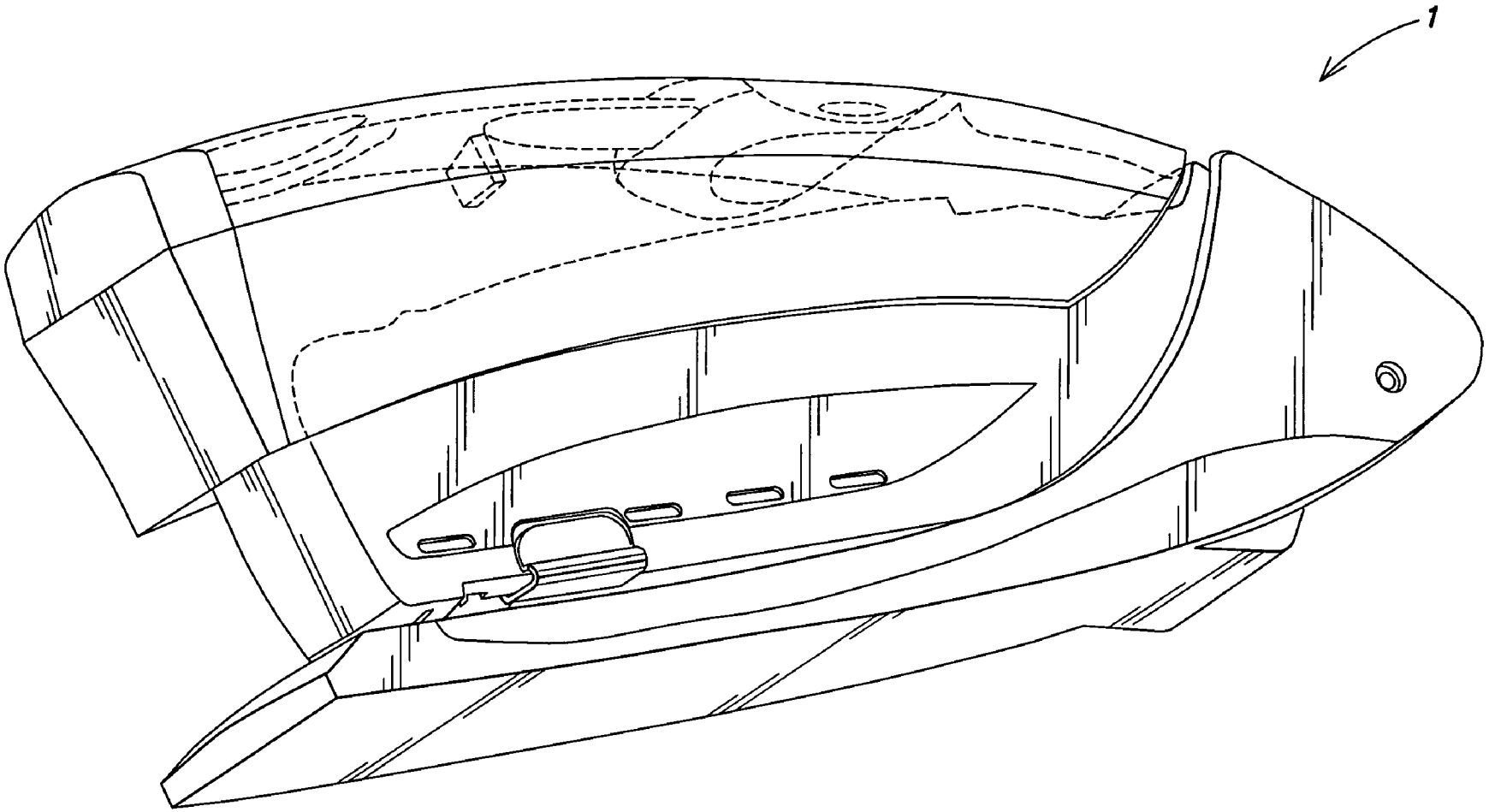

Assembled views of one embodiment of the stapler are shown in FIGS. 10A-10C. As shown in FIG. 10C, a portion of the handle may be formed of transparent or translucent material, although the present invention is not limited in this respect.

In one embodiment, the stapler is configured as a desktop stapler, such as a manual desk top stapler. In one embodiment, the stapler is sized to fit within an envelope of approximately 1.50 inches wide by 8.00 inches long by 3.60 inches high. In another embodiment, the stapler is sized to fit with an envelope of approximately 1.49 inches wide by 6.22 inches long by 3.51 inches high.

One exemplary embodiment of the operation of the stapler will now be described. To load staples into the stapler, a user opens the staple chamber 12 from the bottom. First, the detent/groove interface between the base 4 and body 3 is disengaged and the base 4 is rotated away from the body 3. Once the base 4 has been rotated away from the body 3, as shown in FIG. 3, the engagement securing the second free end of the staple cover 110 to the body 3 is released. Then the staple cover 110 may also be disengaged and rotated away from the rest of the body 3 and handle 2, as shown in FIG. 3. Because of the spring 112 configuration, rotation of the staple cover 110 pulls the staple pusher 111 away from the strike plate 7.

Once the staple chamber 12 is exposed, a stack of staples (or some portion thereof) may be placed in the staple chamber such that the legs of the staples are pointing out of the staple chamber 12 and the back of the staples are supported by the staple chamber 12, as shown in FIG. 3. Once the staples are in the staple chamber 12, the staple cover 110 can be rotated back to close the staple chamber. The staple cover 110 can be latched closed by engaging a latch on the staple cover so that it does not open during use. Then the base 4 can be rotated back to engage the detent/groove interface.

Once filled with staples, the stapler 1 begins in the rest configuration shown in FIGS. 1A and 1B. When a user applies a force to the input location 25, the handle 2 rotates about the handle pivot point 26. As the handle 2 moves down, the plunger 70 contacts a target object. The plunger 70 slides back into the body 3, biasing the plunger spring 73. As the plunger 70 slides upward, the pin 72 on the pusher slides in the helical groove 76 on the body, rotating the lockout body 71. As the lockout body 71 rotates, the stop block 74 is rotated to one side, thus permitting the power spring 8 to deflect. In one embodiment, the power spring may slide against the surface of the stop 81, preventing the lockout body 71 from rotating back to the rest position.

As the handle 2 rotates about the handle pivot point 26, the loading mechanism engaging surface 27 contacts the lever contact portion 100, causing the lever 10 to rotate about the lever pivot point 16. Rotation of the lever 10 loads the return spring 11 and moves the trigger 9 substantially vertically up.

Because the trigger foot 90 engages the free end of the power spring 8, vertical movement of the trigger 9 deflects the free end of the power spring. And because the strike plate 7 is connected to the power spring 8, when the free end of the power spring moves, the strike plate moves as well. As the force on the handle continues, the trigger contact portion 92 contacts the cam 20. This causes the trigger 9 to rotate counterclockwise in the figures about the trigger pivot point 91 and load the trigger spring 15. Once the strike plate 7 is lifted above the staples, the staples in the staple chamber 12 are pushed forward under the bias of the staple pusher 111 and staple chamber spring 112. A staple moves directly under the strike plate 7, taking the position of a driven staple. The driven staple occupies the space that the strike plate 7 was in when the strike plate 7 was in the rest configuration.

Continued rotation of the trigger by the cam as the handle is moved downward relative to the body causes the trigger to disengage from the power spring 8. Once the foot 90 of the trigger 9 clears the power spring 8, the power spring 8 releases its stored energy and the power spring 8 together with the strike plate snap back to the rest position.

The strike plate 7 moves in a substantially vertical path downward, guided by the guides 44. The strike plate 7 contacts the driven staple and shears the staple off the stack of stored staples in the staple chamber 12. The strike plate 7 then drives the driven staple out the gap 120, through the target object, and to the anvil 5 where the ends of the staple are formed.

After the user stops pressing on the handle, the stapler 1 returns to the rest configuration. The lever 10 returns to the position shown in FIGS. 1A and 1B under the bias of the return spring 11. The foot 90 reengages the power spring and is held in place under the bias of the trigger spring 15. The body 3 moves away from the base under the bias of the base spring 13. The plunger 70 moves downward, the plunger spring 73 returns to rest position, and the handle returns to its rest position.

It should be appreciated that various combinations of the above-described embodiments can be employed together, but several aspects of the invention are not limited in this respect. Therefore, although the specific embodiments disclosed in the figures and described in detail employ particular combinations of features, it should be appreciated that the present invention is not limited in this respect, as the various aspects of the present invention can be employed separately, or in different combinations. Thus, the particular embodiments described in detail are provided for illustrative purposes only.

It should also be appreciated that a variety of features employed in the art of staplers may be used in combination with or to modify the above-described features and embodiments.

The foregoing written specification is to be considered to be sufficient to enable one skilled in the art to practice the invention. While the best mode for carrying out the invention has been described in detail, those skilled in the art to which this invention relates will recognize various alternative embodiments including those mentioned above as defined by the following claims. The examples disclosed herein are not to be construed as limiting of the invention as they are intended merely as illustrative of particular embodiments of the invention as enabled herein. Therefore, systems and methods that are functionally equivalent to those described herein are within the spirit and scope of the claims appended hereto. Indeed, various modifications of the invention in addition to those shown and described herein will become apparent to those skilled in the art from the foregoing description and fall within the scope of the appended claims.

What is claimed is:

1. A desktop stapler, comprising:

a body having a staple chamber;

a strike plate movably mounted to the body between a rest position and a loaded position, the strike plate being adapted to drive a staple from the staple chamber and into an object, the strike plate comprising an opening;

a power spring comprising at least one leaf spring the power spring having a first, fixed end fixedly mounted to the body and a second, free end formed as a tab adapted to engage with an edge of the opening in the strike plate, the power spring being adapted to repeatedly move the strike plate from the loaded position to the rest position to drive the staple, with the power spring adapted to provide an output force on the strike plate when the strike plate is in the loaded position, wherein the power spring comprises a rest configuration when the strike plate is in the rest position and a loaded configuration when the strike plate is in the loaded position;

a loading mechanism mounted in the body and adapted to repeatedly move the strike plate from the rest position toward the loaded position, the loading mechanism comprising:

a lever pivotally mounted to the body at a pivot, the lever having a first end and a second end; and a trigger pivotally mounted to the second end of the lever, the trigger having a trigger foot adapted to engage with the power spring;

an actuation surface adapted to cooperate with the trigger to rotate the trigger foot; and a handle pivotally mounted to the body, the handle having a first area contoured to cause the lever to rotate about its pivot point, whereby pivoting the handle causes the first area of the handle to act on the first end of the lever to pivot the lever such that the second end of the lever moves the trigger into contact with the actuation surface and thereby loads the power spring and raises the strike plate from the rest position toward the loaded position whereupon the trigger pivots relative to the lever arm to disengage from the power spring when the strike plate is in the loaded position; and at least one dampener mounted to the body and adapted to absorb some impact of the power spring upon return from the loaded configuration to the rest configuration.

2. The stapler according to claim 1, wherein a distance between the rest position and the loaded position is about 0.400 inches.

3. The stapler according to claim 1, wherein the handle has an input location adapted to receive an input force from a user, wherein a ratio of the output force on the strike plate, when the strike plate is at the loaded position, to the input force on the handle at the input location is about 2.25:1.

4. The stapler according to claim 1, wherein the loading mechanism further comprises a spring coupled between the lever and the trigger to bias the trigger foot into engagement with the power spring.

5. The stapler according to claim 1, wherein the at least one dampener comprises a U-shaped elastomeric material.

6. The stapler according to claim 1, wherein the staple chamber comprises a pivotally mounted cover, the chamber adapted to hold a plurality of staples including at least one stored staple and a driven staple, the cover adapted to support the at least one stored staple that is adjacent to the driven staple.

7. The stapler according to claim 1, further comprising a base pivotally mounted to the body, the base comprising an anvil.

8. The stapler according to claim 7, wherein the staple chamber comprises a pivotally mounted cover.

9. The stapler according to claim 1, further comprising a lockout mounted to the body and operating in a manner to inhibit movement of the strike plate and subsequent driving of a staple unless the body is adjacent to the object.

10. The stapler according to claim 1, wherein the at least one leaf spring is a plurality of leaf springs, each with a different length, clamped together.

11. The stapler according to claim 1, wherein the handle comprises a cam surface adapted to cooperate with the loading mechanism to cause movement of the strike plate.

12. The stapler according to claim 11, wherein the actuation surface comprises the cam surface.

13. A desktop stapler, comprising:

a body;

a strike plate movably mounted to the body between a rest position and a loaded position, the strike plate being adapted to drive a staple;

a leaf spring having a first, fixed portion fixedly mounted to the body and a second, free portion coupled to the strike plate, the leaf spring being adapted to repeatedly move the strike plate from the loaded position to the rest position to drive the staple; and a loading mechanism mounted in the body and arranged to repeatedly move the strike plate from the rest position toward the loaded position, the loading mechanism comprising:

a lever pivotally mounted to the body at a pivot, the lever having a first end and a second end; and a trigger pivotally mounted to the second end of the lever, the trigger having a trigger foot adapted to engage with the leaf spring;

an actuation surface adapted to cooperate with the trigger to rotate the trigger foot; and a handle pivotally mounted to the body, whereby pivoting the handle causes a first area of the handle to act on the first end of the lever to pivot the lever such that the second end of the lever moves the trigger into contact with the actuation surface and thereby loads the leaf spring and raises the strike plate from the rest position toward the loaded position whereupon the trigger pivots relative to the lever arm to disengage from the leaf spring when the strike plate is in the loaded position.

14. The stapler according to claim 13, wherein a distance between the rest position and the loaded position is between about 0.350 inches to about 0.500 inches.

15. The stapler according to claim 14, wherein the distance between the rest position and the loaded position is about 0.400 inches.

16. The stapler according to claim 13, wherein the leaf spring comprises at least one flat spring.

17. The stapler according to claim 13, wherein the leaf spring has a variable flexibility along a length of the leaf spring.

18. The stapler according to claim 17, wherein the leaf spring comprises a plurality of leaf springs cooperating together.

19. The stapler according to claim 18, wherein the plurality of leaf springs comprises three leaf springs clamped together.

20. The stapler according to claim 18, wherein each leaf spring has a length that is different from each other leaf spring.

21. The stapler according to claim 13, wherein the strike plate comprises an opening and wherein the second, free portion of the leaf spring is disposed within the opening of the strike plate.

22. The stapler according to claim 21, wherein the second, free portion of the leaf spring comprises a tab.

23. The stapler according to claim 13, wherein the actuation surface is located on the handle.

24. The stapler according to claim 13, wherein the leaf spring comprises a rest configuration when the strike plate is in the rest position and a loaded configuration when the strike plate is in the loaded position, the stapler further comprising at least one dampener mounted to the body and adapted to absorb at least some impact of the leaf spring upon return from the loaded configuration to the rest configuration.

25. The stapler according to claim 24, wherein the at least one dampener comprises a U-shaped elastomeric material.

26. The stapler according to claim 25, wherein the at least one dampener comprises a plurality of dampeners mounted to the body in spaced apart relation along a length of the leaf spring.

27. The stapler according to claim 13, wherein the body comprises a staple chamber, the staple chamber comprising a pivotally mounted cover, the chamber adapted to hold a plurality of staples including at least one stored staple and a driven staple, the cover adapted to support the at least one stored staple that is adjacent to the driven staple.

28. The stapler according to claim 13, further comprising a base pivotally mounted to the body, the base comprising an anvil.

29. The stapler according to claim 28, wherein the body comprises a staple chamber, the staple chamber comprising a pivotally mounted cover.

30. The stapler according to claim 13, further comprising a lockout mounted to the body and operating in a manner to inhibit movement of the strike plate and subsequent driving of a staple unless the body is adjacent to a target object.

31. The stapler according to claim 13, wherein the handle comprises a cam surface adapted to cooperate with the loading mechanism to cause movement of the strike plate.

32. The stapler according to claim 31, wherein the actuation surface comprises the cam surface.

33. The stapler according to claim 13, wherein a distance between the rest position and the loaded position is between about 0.300 inches and about 0.600 inches.

34. The stapler according to claim 13, wherein the first area is contoured to cause the lever to rotate about its pivot point.

35. A desktop stapler, comprising:

a body;

a strike plate movably mounted to the body between a rest position and a loaded position, the strike plate being adapted to drive a staple;

a leaf spring coupled to the body and cooperating with the strike plate, the leaf spring being adapted to provide an output force on the strike plate when the strike plate is in the loaded position;

a loading mechanism mounted in the body and arranged to repeatedly move the strike plate from the rest position toward the loaded position, the loading mechanism comprising:

a lever pivotally mounted to the body at a pivot; and a trigger having a trigger foot adapted to engage with the leaf spring;

an actuation surface; and a handle mounted to the body and cooperating with the loading mechanism, whereby pivoting the handle causes the lever to pivot such that the lever moves the trigger into contact with the actuation surface and thereby loads the leaf spring and raises the strike plate from the rest position toward the loaded position whereupon the trigger foot disengages from the leaf spring.

36. The stapler according to claim 35, wherein the handle has an input location adapted to receive an input force from a user, wherein a ratio of the output force on the strike plate, when the strike plate is at the loaded position, to the input force on the handle at the input location is in a range between about 2:1 and about 4:1.

37. The stapler according to claim 35, wherein the ratio of the output force to the input force is about 2.25:1.

38. The stapler according to claim 35, wherein the leaf spring has a variable flexibility along a length of the leaf spring.

39. The stapler according to claim 38, wherein the leaf spring comprises a plurality of leaf springs cooperating together.

40. The stapler according to claim 39, wherein the plurality of leaf springs comprises three leaf springs clamped together.

41. The stapler according to claim 39, wherein each leaf spring has a length that is different from the other leaf springs.

42. The stapler according to claim 35, wherein the lever has a first end and a second end engaged with the leaf spring, wherein movement of the first end about the pivot causes the strike plate to move from the rest position toward the loaded position.

43. The stapler according to claim 42, wherein the trigger is mounted to the second end of the lever.

44. The stapler according to claim 43, wherein the trigger is pivotally mounted to the second end of the lever.

45. The stapler according to claim 44, wherein the handle comprises the actuation surface, and further comprises a loading mechanism engaging surface adapted to engage the first end of the lever.

46. The stapler according to claim 35, wherein the leaf spring comprises a rest configuration when the strike plate is in the rest position and a loaded configuration when the strike plate is in the loaded position, the stapler further comprising at least one dampener mounted to the body and adapted to absorb at least some impact of the leaf spring upon return from the loaded configuration to the rest configuration.

47. The stapler according to claim 46, wherein the at least one dampener comprises a U-shaped elastomeric material.

48. The stapler according to claim 46, wherein the at least one dampener comprises a plurality of dampeners mounted to the body in spaced apart relation along a length of the leaf spring.

49. The stapler according to claim 35, wherein the body comprises a staple chamber, the staple chamber comprising a pivotally mounted cover, the chamber adapted to hold a plurality of staples including at least one stored staple and a driven staple, the cover adapted to support the at least one stored staple that is adjacent to the driven staple.

50. The stapler according to claim 35, further comprising a base pivotally mounted to the body, the base comprising an anvil.

51. The stapler according to claim 50, wherein the body comprises a staple chamber, the staple chamber comprising a pivotally mounted cover.

52. The stapler according to claim 35, further comprising a lockout mounted to the body and operating in a manner to inhibit movement of the strike plate and subsequent driving a staple unless the body is adjacent to a target object.

53. The stapler according to claim 35, wherein the handle having an input location adapted to receive an input force from a user, wherein a ratio of the output force on the strike plate, when the strike plate is at the loaded position, to the input force on the handle at the input location is in a range between about 2:1 and about 5:1.

54. The stapler according to claim 35, further comprising a cam surface on the handle, wherein the cam surface is adapted to cooperate with the loading mechanism to cause movement of the strike plate.

55. The stapler according to claim 54, wherein the actuation surface comprises the cam surface.

* * * * *